US010700437B2

(12) United States Patent
Song et al.

(10) Patent No.: US 10,700,437 B2
(45) Date of Patent: Jun. 30, 2020

(54) APPARATUS AND METHOD FOR CONTROLLING BEAM IN WIRELESS COMMUNICATION SYSTEM

(71) Applicant: POSTECH ACADEMY-INDUSTRY FOUNDATION, Pohang-si, Gyeongsangbuk-do (KR)

(72) Inventors: Ho-Jin Song, Pohang-si (KR); Wonbin Hong, Seoul (KR); Yoonyoung Chung, Busan (KR); Sungmin Cho, Daegu (KR)

(73) Assignee: POSTECH ACADEMY-INDUSTRY FOUNDATION, Pohang-si, Gyeongsangbuk-do ( * ) Notice: Subject to any disclaimer, the term of this patent is extended or adjusted under 35 U.S.C. 154(b) by 46 days.

(21) Appl. No.: 16/100,765

(22) Filed: Aug. 10, 2018

(65) Prior Publication Data

US 2019/0058257 A1 Feb. 21, 2019

(30) Foreign Application Priority Data

Aug. 21, 2017 (KR) ..... 10-2017-0105359
Mar. 15, 2018 (KR) ..... 10-2018-0030123

(51) Int. Cl.
*H01Q 15/04* (2006.01)
*H01Q 3/26* (2006.01)
(Continued)

(52) U.S. Cl.
CPC ..... *H01Q 15/04* (2013.01); *H01Q 3/267* (2013.01); *H01Q 3/46* (2013.01); *H01Q 15/12* (2013.01); *H01Q 19/06* (2013.01)

(58) Field of Classification Search
CPC ..... H01Q 15/04; H01Q 3/46; H01Q 19/06; H01Q 15/12; H01Q 3/267
(Continued)

(56) References Cited

U.S. PATENT DOCUMENTS 6,822,622 B2 * 11/2004 Crawford ..... H01Q 15/002 343/754
7,015,865 B2 3/2006 Isaacs et al.
(Continued)

FOREIGN PATENT DOCUMENTS

DE 39 21 341 A1 2/2009
EP 2 822 096 A1 1/2015

OTHER PUBLICATIONS

Extended European Search Report dated Jan. 16, 2019, issued in European Application No. 18188569.0.

*Primary Examiner* — Khai M Nguyen
(74) *Attorney, Agent, or Firm* — Jefferson IP Law, LLP

(57) ABSTRACT

A communication device for controlling a beam in a wireless communication system and a method therefor are provided. The communication device includes a lens including at least one layer in which unit cells are disposed, at least one processor configured to determine a beam pattern and control capacitance of each of the unit cells based on the beam pattern, and a transceiver for transmitting a signal in the determined beam pattern through the lens, which is capacitance-controlled. Each unit cell includes a first conductive member, a second conductive member overlapping at least a portion of the first conductive member, and spaced apart from the first conductive member, and a dielectric interposed between the overlapped portions of the first conductive member and the second conductive member. An overlap region of the first and second conductive members is arranged in a direction shielded from an external electromagnetic wave.

20 Claims, 34 Drawing Sheets

(51) Int. Cl.
*H01Q 3/46* (2006.01)
*H01Q 19/06* (2006.01)
*H01Q 15/12* (2006.01)

(58) Field of Classification Search
USPC ..... 343/702
See application file for complete search history.

(56) References Cited

U.S. PATENT DOCUMENTS

| | | | | |
|---|---|---|---|---|
| 7,245,269 | B2 * | 7/2007 | Sievenpiper | H01Q 3/46 343/700 MS |
| 8,912,973 | B2 | 12/2014 | Werner et al. | |
| 2010/0220035 | A1 * | 9/2010 | Lee | H01Q 15/02 343/909 |
| 2017/0062945 | A1 | 3/2017 | Foo | |
| 2018/0316090 | A1 | 11/2018 | Foo | |

* cited by examiner

APPARATUS AND METHOD FOR CONTROLLING BEAM IN WIRELESS COMMUNICATION SYSTEM

CROSS-REFERENCE TO RELATED APPLICATION(S)

This application is based on and claims priority under 35 U.S.C. § 119 of a Korean patent application number 10-2017-0105359, filed on Aug. 21, 2017, in the Korean Intellectual Property Office, and of a Korean patent application number 10-2018-0030123, filed on Mar. 15, 2018, in the Korean Intellectual Property Office, the disclosure of each of which is incorporated by reference herein in its entirety.

BACKGROUND

1. Field

The disclosure relates to wireless communication systems. More particularly, the disclosure relates to an apparatus and method for controlling a beam in a wireless communication system.

2. Description of Related Art

Recently, beamforming technology has been utilized in order to increase communication speed, expand a service area, improve radar sensitivity and resolution in wireless communication and radar systems. For beamforming, it may be required to control the beam direction and beam width of an electromagnetic wave.

For beam pattern control, a phased array antenna may be utilized. In the phased array antenna, a plurality of antennas are arranged one-dimensionally or two-dimensionally. The phased array antenna is capable of delaying a signal radiated from each antenna such that a radiation pattern of a final beam has a specific direction or shape. The phased array antenna may be implemented by radio frequency (RF) integrated circuit technology based on a complementary metal-oxide semiconductor (CMOS), or may be integrated in a circuit using separate packaging means.

For beam pattern control, optical devices such as lenses or mirrors may be utilized. A passive optical component, such as a lens or a mirror, may be mechanically controlled through an actuator, such as a motor, and a beam pattern may be controlled.

The beam pattern control as described above should satisfy conditions such as low power and low latency in order to satisfy requirements in a wireless communication system.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide an apparatus and method for controlling a beam in a wireless communication system.

Another aspect of the disclosure is to provide a method and apparatus for controlling a beam with low power and low latency using a lens.

Another aspect of the disclosure is to provide a method and apparatus for controlling a beam pattern by controlling unit cells of a lens with an electrical signal.

Another aspect of the disclosure is to provide a unit cell structure that is capable of maintaining non-resonance and dipole characteristics for an external electromagnetic wave.

Another aspect of the disclosure is to provide a layout structure of control wires in order to prevent control wires, which controller cells, from shielding an external electromagnetic wave.

Another aspect of the disclosure is to provide a layout structure of control wires that makes a layer of control wires for controlling unit cells function as a polarization plate.

Another aspect of the disclosure is to provide a unit cell structure for performing polarization conversion.

Additional aspects will be set forth in part in the description which follows and, in part, will be apparent from the description, or may be learned by practice of the presented embodiments.

In accordance with an aspect of the disclosure, a communication device for controlling a beam in a wireless communication system is provided. The device includes a lens including at least one layer in which a plurality of unit cells are disposed, at least one processor configured to determine a beam pattern, and control capacitance of each of the plurality of unit cells based on the beam pattern, and a transceiver configured to transmit a signal in the determined beam pattern through the lens, the lens being capacitance-controlled. Here each of the plurality of unit cells includes a first conductive member, a second conductive member disposed in a manner of overlapping at least a portion of the first conductive member, and spaced apart from the first conductive member, and a dielectric interposed between overlapped portions of the first conductive member and the second conductive member. An overlap region of the first conductive member and the second conductive member is arranged in a direction shielded from an external electromagnetic wave.

In accordance with another aspect of the disclosure, a method for operating a communication device for controlling a beam in a wireless communication system is provided. The method includes determining a beam pattern, controlling capacitance of each of the plurality of unit cells based on the beam pattern, and transmitting a signal in the determined beam pattern through the lens, the lens being capacitance-controlled. The plurality of unit cells are disposed in at least one layer included in the lens, and each of the plurality of unit cells includes a first conductive member, a second conductive member disposed by overlapping at least a portion of the first conductive member, and disconnected from the first conductive member, and a dielectric interposed between overlapped portions of the first conductive member and the second conductive member. An overlap region of the first conductive member and the second conductive member is arranged in a direction shielded from an external electromagnetic wave.

The apparatus and method according to various embodiments of the disclosure enable control of a beam pattern with low power and low latency by controlling the capacitance of the unit cells of the lens with an electrical signal.

In the apparatus and method according to various embodiments of the disclosure, the variable capacitor region of a unit cell is disposed in a direction shielded from an external electromagnetic wave. Thus, it is possible to make the structure of the unit cell to maintain a dipole structure as a whole, and to effectively control a beam pattern through the lens in a wide band.

In the apparatus and method according to various embodiments of the disclosure, control wires for controlling unit cells are disposed in different layers. Thus, an external electromagnetic wave can pass through the lens without interference, loss, or shielding by the control wires.

In the apparatus and method according to various embodiments of the disclosure, a layer of unit cells performing polarization conversion is disposed between the control wire layers functioning as polarizing plates. Thus, it is possible to reduce a physical distance between the control wire layers while making an electrical equivalent distance between the control wire layers satisfy predetermined criteria. It is possible to realize complete physical integration of polarizing filters and unit cell layers.

Effects which can be acquired by the disclosure are not limited to the above described effects, and other effects that have not been mentioned may be clearly understood by those skilled in the art from the following description.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Hereinafter, various embodiments of the disclosure will be described based on an approach of hardware. However, various embodiments of the disclosure include a technology that uses both hardware and software and thus, the various embodiments of the disclosure may not exclude the perspective of software.

The disclosure described below relates to an apparatus and method for controlling a beam in a wireless communication system. Specifically, the disclosure discloses a technique for controlling the pattern of a beam by controlling the capacitance of a lens in a wireless communication system. Various terms used in the following description are illustratively used for convenience of explanation. Accordingly, the disclosure is not limited to the terms to be used later, and other terms having equivalent technical meanings may be used.

Figure 1:
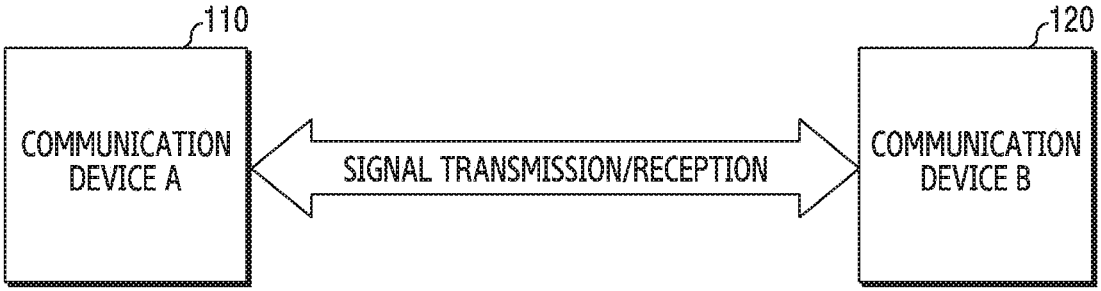
FIG. 1 illustrates a wireless communication environment according to an embodiment of the disclosure.

FIG. 1 illustrates a wireless communication environment according to an embodiment of the disclosure. FIG. 1 illustrates a communication device A 110 and a communication device B 120 as nodes using a wireless channel in a wireless communication system.

Referring to FIG. 1, the communication device A 110 may transmit a signal to the communication device B 120. In other words, the communication device B 120 may receive a signal from the communication device A 110. The communication device A 110 may form a beam for transmission/reception of a signal, and may transmit a signal to the communication device B 120 using the beam. In addition, the communication device A 110 may receive a signal from the communication device B 120 using the beam. The communication device A 110 may control a beam pattern. The beam pattern may include at least one of a beam direction and/or a beam width. For example, the communication device A 110 may include a lens, and may control the beam pattern by controlling the beam to pass through the lens.

For example, in downlink communication, the communication device A 110 may be a base station and the communication device B 120 may be a terminal. As another example, in uplink communication, the communication device A 110 may be a terminal and the communication device B 120 may be a base station. In addition, in device to device (D2D) communication, the communication device A 110 may be a terminal and the communication device B 120 may be another terminal. Here, the D2D communication may be referred to as side link communication. In addition, the communication apparatus A 110 may be a base station, and the communication apparatus B 120 may be another base station. In addition to the examples listed, the communication device A 110 and the communication device B 120 may be other various devices.

The communication device A 110 and the communication device B 120 may include at least one antenna. In other words, the communication device A 110 and the communication device B 120 may include a single antenna, or may include a plurality of antennas. According to various embodiments of the disclosure, when each of the communication device A 110 and the communication device B 120 includes a plurality of antennas, this may be referred to as a multiple-input multiple-output (MIMO) system in which the communication device A 110 transmits a signal through a plurality of transmission antennas and the communication device B 120 receives a signal through a plurality of reception antennas.

Hereinafter, for convenience of explanation, descriptions will be made assuming that a main agent of an operation is the communication device A 110 in FIGS. 2 through 15. However, this is for convenience of explanation only, and the functions of devices are not limited by names.

Figure 2:
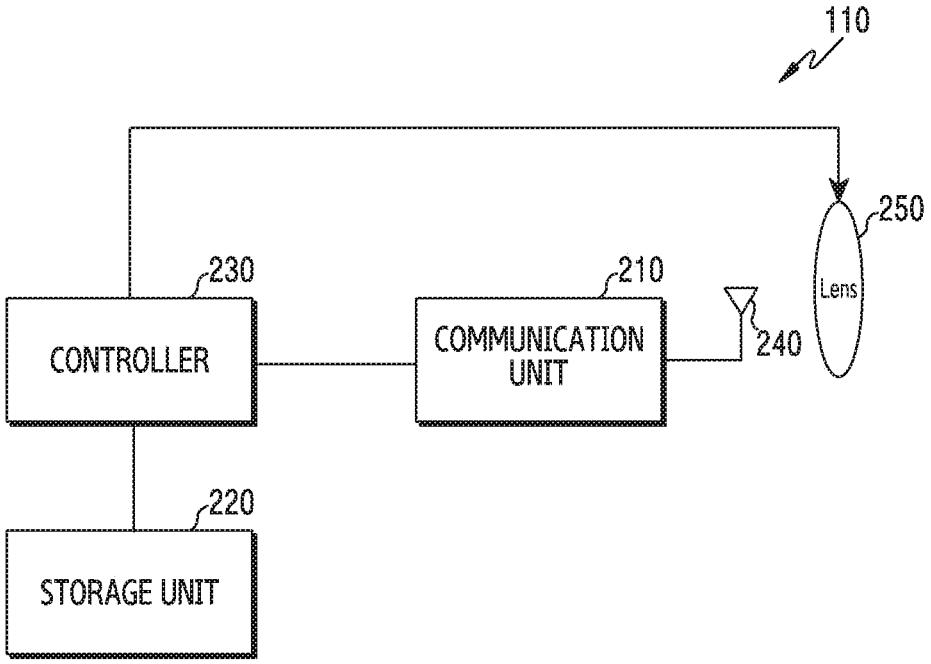
FIG. 2 illustrates the functional configuration of a communication device for controlling a beam in a wireless communication system according to an embodiment of the disclosure.

FIG. 2 illustrates the functional configuration of a communication device for controlling a beam in a wireless communication system according to an embodiment of the disclosure. The configuration exemplified in FIG. 2 may be understood as the configuration of the communication device A 110. Terms such as "~unit" and "-module" to be used below units for processing at least one function or operation, and may be implemented by hardware, software, or a combination of hardware and software.

Referring to FIG. 2, a communication device may include a communication unit 210 (e.g., a transceiver), a storage unit 220 (e.g., a memory), a controller 230 (e.g., at least one processor), an antenna 240, and a lens 250.

The communication unit 210 may perform functions for transmitting/receiving signals through a wireless channel. For example, the communication unit 210 may perform a conversion function between a baseband signal and a bit sequence according to a physical layer specification of the system. For example, when transmitting control information, the communication unit 210 may generate modulation symbols by encoding and modulating a transmission bit stream. Also, when receiving data, the communication unit 210 may recover a received bit stream through demodulation and decoding of the baseband signal. In addition, the communication unit 210 may up-convert the baseband signal to a radio frequency (RF) band signal, transmit the RF band signal through the antenna 240, and down-convert the RF band signal received through the antenna 240 to a baseband signal. For example, the communication unit 210 may include a decoder, a demodulator, an analog to digital converter (ADC), a reception filter, an amplifier, a mixer, an oscillator, and so on. In addition, when the communication unit 210 transmits a signal, the communication unit 210 may further include an encoder, a modulator, a digital to analog converter (DAC), and a transmission filter.

FIG. 2 illustrates one antenna 240 for convenience of explanation. The communication unit 210 may include a plurality of antennas. The communication unit 210 may receive a plurality of streams through each of the plurality of antennas. In addition, the communication unit 210 may include a plurality of RF chains. Further, the communication unit 210 may perform beamforming. Beamforming may include analog beamforming and digital beamforming.

The communication unit 210 transmits/receives signals as described above. Accordingly, all or a part of the communication unit 210 may be referred to as a transmitter, a receiver, or a transceiver. In the following description, the transmission and reception performed through wireless channels are used to mean that the processing as described above is performed by the communication unit 210.

The storage unit 220 may store data such as a basic program, an application, and setting information for operation of the communication device. The storage unit 220 may be configured as volatile memory, nonvolatile memory, or a combination of volatile memory and nonvolatile memory. In addition, the storage unit 220 may provide the data stored therein in response to the request of the controller 230.

The controller 230 may control the overall operations of the communication device. For example, the controller 230 may transmit and receive signals through the communication unit 210. In addition, the controller 230 may read/write data from/to the storage unit 220. The controller 230 may perform functions of a protocol stack required by the communication standard. To this end, the controller 230 may include at least one processor or a microprocessor, or may be configured as a part of the processor. The controller 230 can control the lens 250 individually.

Antenna 240 may radiate an electromagnetic wave in order to transmit a signal. The electromagnetic wave may be radiated in the form of a beam through the antenna 240. The beam radiated from the antenna 240 may be controlled in through the lens 250. In other words, the beam radiated from the antenna 240 may be controlled in direction and/or width through the lens 240. According to various embodiments of the disclosure, the antenna 240 may control the pattern of the beam. In this case, the antenna 240 may include a plurality of antenna elements capable of controlling the phase of a signal.

The lens 250 is capable of changing the direction and width of the beam incident on the lens 250. For example, the lens 250 may refract the incident beam according to the refractive index of the lens 250, thereby changing the direction of the beam. The lens 250 may include a plurality of unit cells. Each of the plurality of unit cells may have a fixed or variable permittivity, and the pattern of the beam passing through the lens 250 may be determined according to the capacitance distribution or the refractive index distribution of the unit cells.

FIG. 2 illustrates the configuration of a communication device as an example. Here, when the configuration of FIG. 2 is the configuration of a base station, the communication device may further include a backhaul communication unit for providing an interface for performing communication with a backhaul network.

Figure 3:
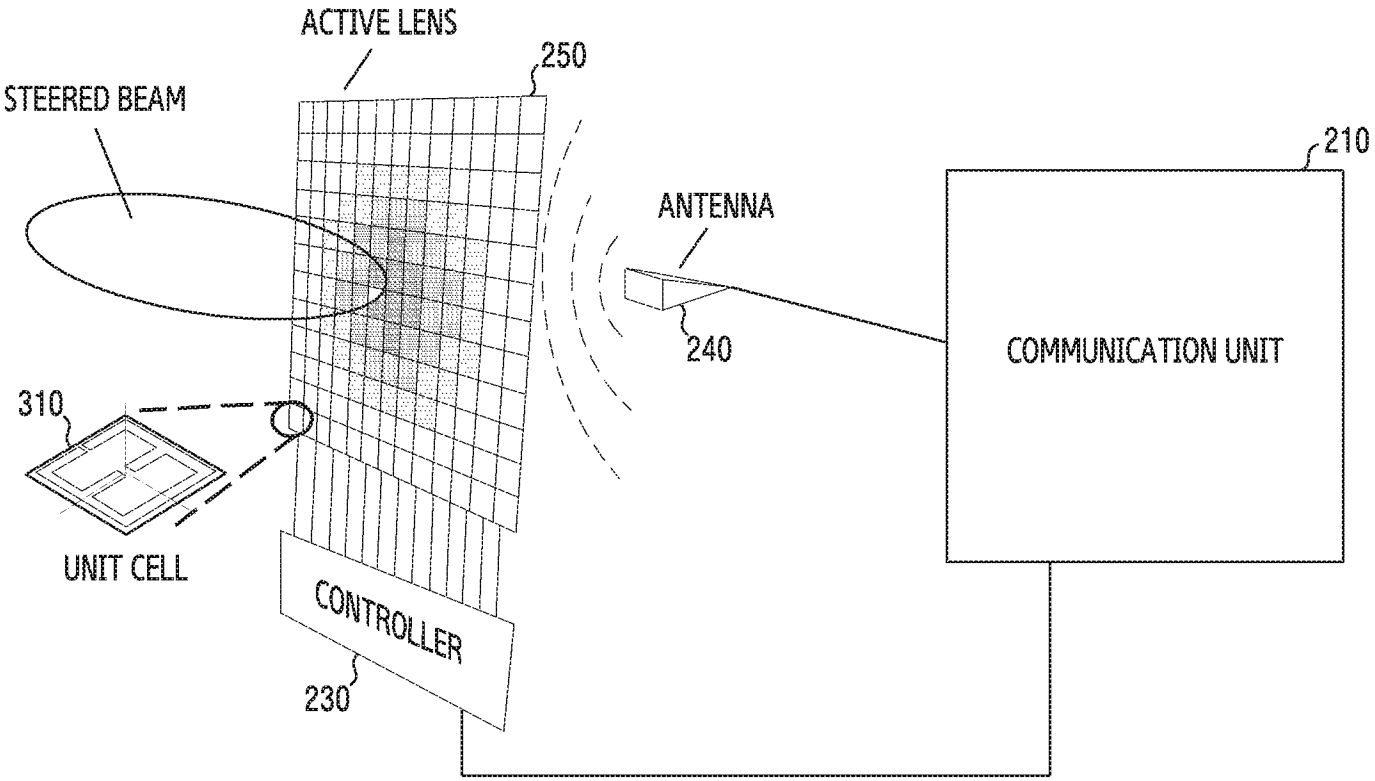
FIG. 3 illustrates a configuration for controlling a beam in a communication device according to an embodiment of the disclosure.

FIG. 3 illustrates a configuration for controlling a beam in a communication device according to an embodiment of the disclosure.

Referring to FIG. 3, a controller 230, an antenna 240, a controller 250, and a communication unit 210 as the configuration for controlling a beam. However, this is for convenience of explanation, and the configuration for controlling a beam may not include some of the controller 230, the antenna 240, the controller 250, and the communication unit 210, or may further include other configurations.

The antenna 240 may form a beam in order to transmit a signal. The antenna 240 may radiate a signal in the form of a plane wave or a spherical wave according to the formed beam. An electromagnetic wave corresponding to the signal transmitted through the antenna 240 may be incident on the lens 250. Hereinafter, a signal being transmitted through the antenna 240 based on beamforming, it may be expressed as a beam being incident on the lens 250 or an electromagnetic wave corresponding to the signal being incident on the lens 250.

The lens 250 is capable of changing the pattern of the beam incident on the lens 250. The pattern of the beam incident on the lens 250 may be changed according to the refractive index distribution of the lens 250. The lens 250 may include at least one layer in which a plurality of unit cells including a unit cell 310 are disposed. Each of the plurality of unit cells may have specific capacitance (or refractive index). Therefore, the pattern of a beam incident on the lens 250 may be changed according to the refractive index distribution of the plurality of unit cells.

The controller 230 is connected to the lens 250, and may control or change the capacitance of each of the plurality of unit cells included in the lens 250. In other words, the controller 230 may change the refractive index distribution of the lens 250. To this end, the lens 250 may include control wires so as to allow the controller 230 to control the unit cells of the lens 250. The controller 230 may control the capacitance of each of the plurality of unit cells included in the lens 250 so as to change the pattern of a beam incident on the lens 250 to a desired pattern.

The unit cell 310 is a unit constituting the lens 250 and may include at least one dielectric. The dielectric may include at least one of, for example, a semiconductor device, a liquid crystal material, and a photoelectric material. Further, the dielectric may have a variable permittivity or a fixed permittivity. When the dielectric has a variable permittivity, the permittivity of the dielectric may be changed by an external electrical signal. According to various embodiments of the disclosure, the unit cell 310 may include a variable capacitor region that functions as a variable capacitor. The variable capacitor region may include a dielectric and the capacitance of the unit cell 310 may be changed when the permittivity of the dielectric is changed by an external electrical signal (e.g., a control signal from the controller 230) or when the variable capacitor region is physically changed. Accordingly, when the controller 230 appropriately controls the capacitance of the unit cells 310 and the other unit cells of the lens 250, the pattern of a beam incident on the lens 250 may be changed to a specific pattern. According to various embodiments of the disclosure, the size of the unit cell 310 may be 1/10 to 1 times the wavelength length of an electromagnetic wave incident on the lens 250.

In general, a principle in which an optical lens modulates the direction and radiation pattern of an electromagnetic wave is to process a material having a specific refractive index (or permittivity) to have a specific surface curvature (e.g., a lens for a microscope or spectacles). However, in the case of refractive index gradient optics, the direction and radiation pattern of an electromagnetic wave can be modulated by modulating the refractive index depending on a position in the lens having a planar surface. The principle in which the direction and radiation pattern of an electromagnetic wave are modulated in a lens having a planar surface will be described in more detail with reference to FIG. 4.

Figure 4:
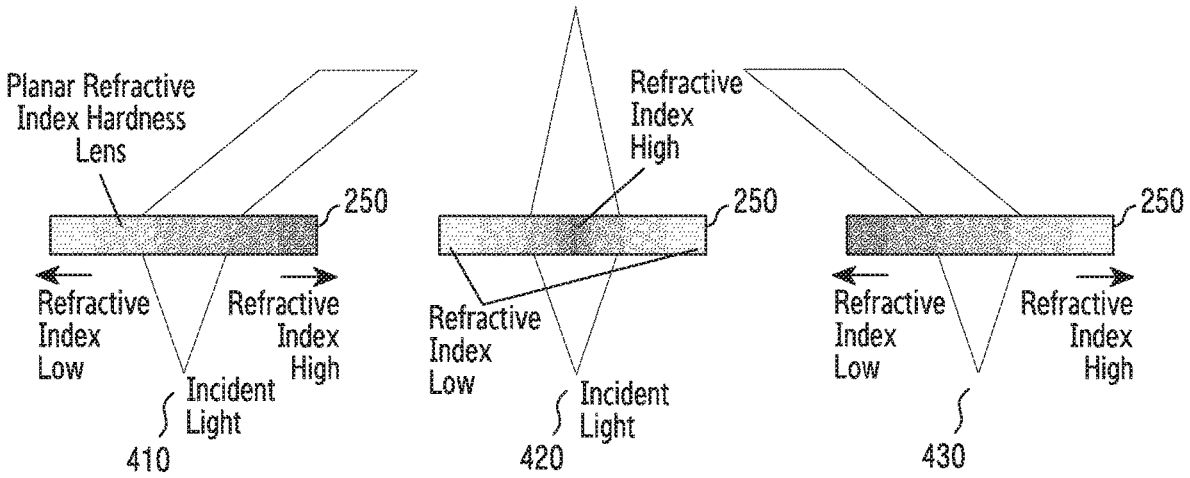
FIG. 4 illustrates a principle in which an electromagnetic wave incident on a lens is controlled according to an embodiment of the disclosure.

FIG. 4 illustrates a principle in which an electromagnetic wave incident on a lens are controlled according to an embodiment of the disclosure.

Referring to FIG. 4, light incident on the lens 250 (incident light or electromagnetic waves) is refracted by the lens 250 to a portion having a high refractive index. For example, when the lens 250 has a refractive index distribution 410 in which the right portion of the lens 250 has a refractive index higher than that of the left portion of the lens 250, the light incident on the lens 250 is refracted to the right. As another example, when the lens 250 has a refractive index distribution 420 in which the left portion of the lens 250 has a refractive index higher than that of the right portion of the lens 250, the light incident on the lens 250 is refracted to the left. As another example, when the lens 250 has a refractive index distribution 430 in which the refractive index of the opposite end portions of the lens 250 is relatively low and the refractive index of the central portion of the lens 250 is relatively high, the light incident on the lens 250 is focused to the central portion of the lens 250.

Since most optical lenses (e.g., spectacle lenses) cannot change the shape or refractive index thereof, the shape of a beam incident on a lens, and the direction and radiation pattern of an electromagnetic wave cannot be actively changed. However, when a lens is made of an optical material, the shape of which can be changed, the shape of a beam incident on the lens, the direction and radiation pattern of an electromagnetic wave can be actively changed. For example, a human lens is composed of a flexible optical material. Thus, the shape of the lens can be changed by the mechanical movement of the muscles around the eye, and the lens can actively control a light wave (electromagnetic wave) through the change of the shape thereof. As another example, when the refractive index of a unit cell is controlled by an external electric signal depending on the position of the unit cell in the lens based on the principle of the refractive index hardness optical system, the shape of a beam incident on the lens and the direction and radiation pattern of an electromagnetic wave can be actively changed. As illustrated in FIG. 3, the controller 230 may cause the direction of the beam incident on the lens to be changed to a desired direction by controlling the individual unit cells of the lens 250 to change the capacitance (or the refractive index) of the unit cells. For example, when the controller 230 sets the refractive index of the unit cells located in the central portion of the lens 250 to be relatively high and the refractive index of the unit cells located in the peripheral portion of the lens 250 to be relatively low, an electromagnetic wave generated by the antenna 240 and incident on the lens 250 may be focused to the central portion of the lens 250 while passing through the lens 250 (or, the beam width of a beam incident on the lens 250 may be narrowed, or an electromagnetic wave incident on the lens 250 may be focused at a specific distance).

According to various embodiments of the disclosure, the structure of a unit cell capable of controlling capacitance may be a ring structure or a modified ring structure. When a circuit element (e.g., a micro electro-mechanical system (MEMS), an optoelectronic material, or a semiconductor device) is combined with a part of such a ring structure or a modified ring structure, the capacitance characteristics of the circuit element may be controlled by an external electrical signal. In other words, the ring structure or the modified ring structure may change a resonance frequency for an external electromagnetic wave, and may thus have variable capacitance characteristic with respect to the external electromagnetic wave.

However, the unit cell having the ring structure or the modified ring structure may have a problem in that the bandwidth capable of changing actual capacitance is very narrow due to the resonance characteristic. Accordingly, various embodiments of the disclosure propose a non-resonant, capacitively controllable unit cell structure capable of changing capacitance in a wide band, which will be described in more detail in FIGS. 5A and 5B below.

Figure 5A:
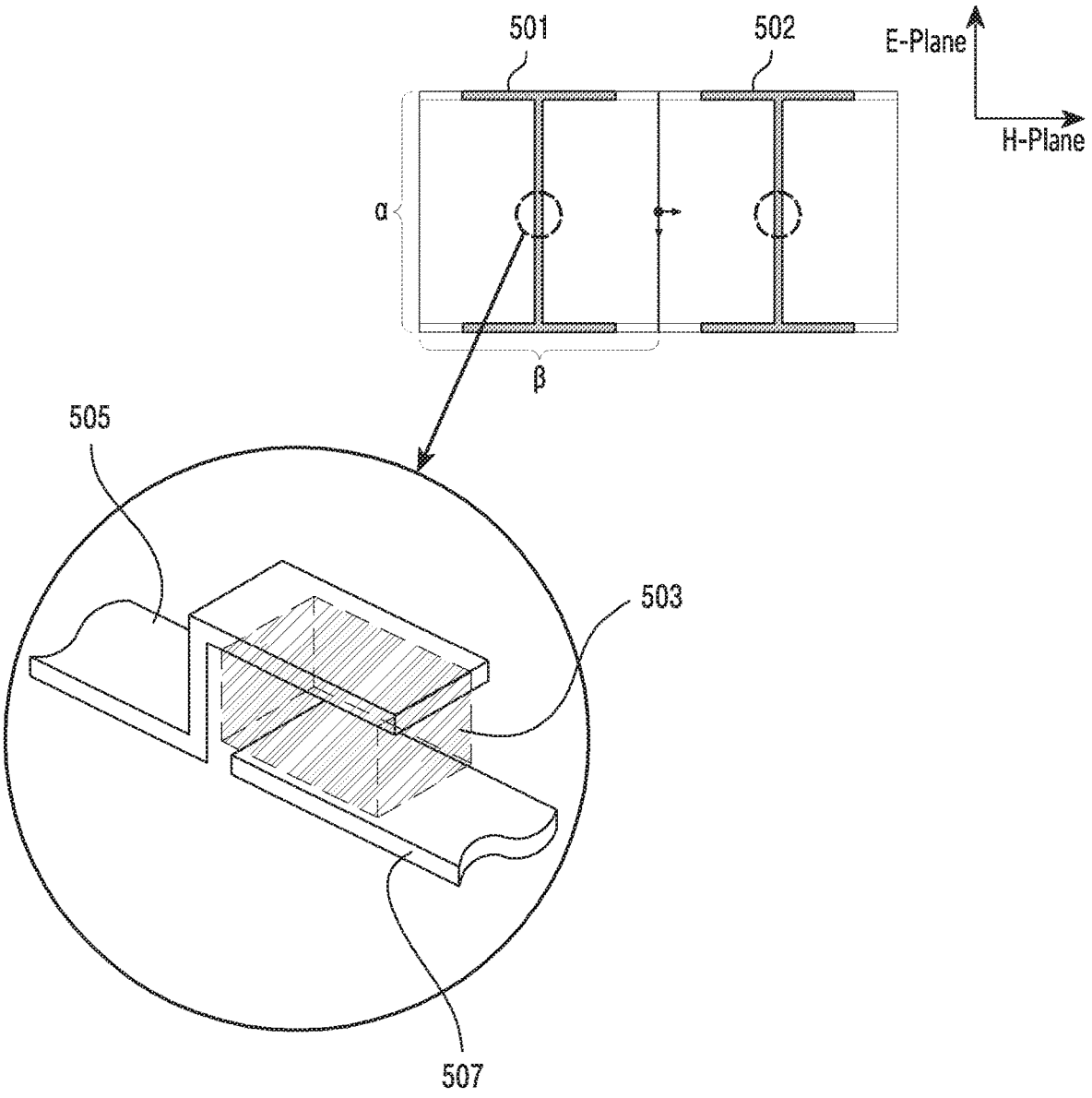
FIGS. 5A and 5B illustrate unit cell structures of a lens according to various embodiments of the disclosure.
Figure 5B:
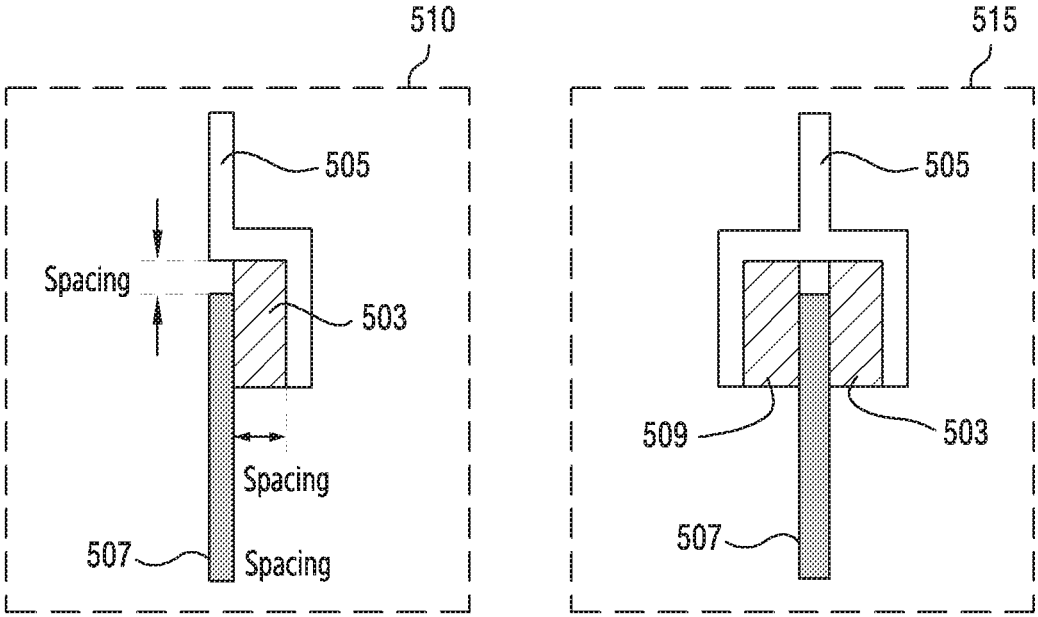

FIGS. 5A and 5B illustrate a unit cell structure of a lens according to various embodiments of the disclosure. FIG. 5A illustrates a perspective view of a unit cell 501 (and a unit cell 502), and FIG. 5B illustrates a side view of the unit cell 501. Hereinafter, the structure of the unit cell 501 will be described with reference to FIGS. 5A and 5B for convenience of explanation. However, the other unit cells of the lens 250 may also have the same structure as the unit cell 501 described below.

Referring to FIG. 5A, the unit cell 501 may have an I-shaped or overturned H-shaped structure as a whole. In the unit cell 501 having such a structure, the structure of a "-" shape at the opposite ends of the unit cell 501 may be referred to as a "head portion (or tail portion)", and a structure of a "|" shape connecting the head portion and the tail portion may be referred to as a "waist portion". According to various embodiments of the disclosure, as illustrated in FIG. 5A, the vertical length of the unit cell 501 may be defined as a, and the horizontal length may be defined as β. For example, the vertical length α of the unit cell 501 may be 500 μm, and the horizontal length β may be 800 μm. However, this is exemplary, and various modifications are possible with respect to the vertical length α and/or the horizontal length β of the unit cell 501. Further, according to various embodiments of the disclosure, the size of the unit cell 501 may be expressed as the product of the vertical length α and the horizontal length β of the unit cell 501 (i.e., α×β). However, the above-described definition of the size of the unit cell 501 is exemplary and does not exclude various expressions for defining the size of the unit cell 501.

Referring to the unit cell structure 510 of FIGS. 5A and 5B, the unit cell 501 includes a first conductive member 505, a second conductive member 507 disposed in a manner of overlapping at least a portion of the first conductive member 505 and spaced apart from the first conductive member 505, and a dielectric 503 interposed between the overlapped portions of the first conductive member 505 and the second conductive member 507. According to various embodiments of the disclosure, with respect to the unit cell having such a structure, the end portion, which is not connected to the dielectric in one conductive member of the unit cell, may be referred to as the head portion, and the portion of another conductive member may be referred to as the waist portion.

According to the structure of the unit cell 501 described above, the first conductive member 505 and the second conductive member 507 may be physically or electrically disconnected, and the overlap region of the first conductive member 505 and the second conductive member 507 may include the dielectric 503. When a voltage is applied between the first conductive member 505 and the second conductive member 507, the overlap region of the first conductive member 505 and the second conductive member 507 may function as a variable capacitor. In various embodiments of the disclosure, a region that functions as a variable capacitor in each unit cell may be defined as a "variable capacitor region". In other words, the variable capacitor region may be defined as a region including the overlapped portions of the conductive members included in the unit cell and a dielectric interposed between the overlapped portions of the conductive members. The capacitance of the unit cell 501 can be changed by changing the permittivity of the dielectric 503 by an electrical signal from the outside or physically changing the variable capacitor region.

According to various embodiments of the disclosure, the overlap region of the first conductive member 505 and the second conductive member 507 (i.e., the variable capacitor region of the unit cell 501) is disposed in a direction shielded from an external electromagnetic wave. According to various embodiments of the disclosure, the "direction shield from an external electromagnetic wave" is a direction not affected by an external electromagnetic wave, which, in a unit cell (e.g., the unit cell 501), for example, may mean a direction in which the external electromagnetic wave is incident perpendicularly on the conductive members in the variable capacitor region. In addition, the "direction shielded from an external electromagnetic wave" may mean a direction in which an electric field component of an external electromagnetic wave perpendicularly incident on the unit cell and an electric field component formed according to voltage application in the variable capacitor region of the unit cell becomes perpendicular to each other. By arranging the variable capacitor region of the unit cell 501 in the direction shielded from an external electromagnetic wave, the unit cell 501 may have a non-resonance characteristic and the capacitance of the unit cell 501 can be controlled in the wide band. In addition, the I-shaped or overturned H-shaped structure of the unit cell 501 is capable of making the unit cell 501 maintain an electric dipole characteristic as a whole. Here, the size of a dipole is adjustable by the capacitance of the unit cell 501. The dielectric 503 may include at least one of, for example, a semiconductor device, a liquid crystal material, and a photoelectric material, the permittivity of which can be changed by an external electrical signal.

According to various embodiments of the disclosure, the unit cell 501 may have the same structure as the unit cell structure 515. In this case, the second conductive member 507 may overlap a portion of the first conductive member 505 and another portion of the first conductive member 505, and a dielectric 503 and a dielectric 509 may be interposed between respective overlapped portions. Here, in the unit cell 501, each of the variable capacitor regions may be disposed in a direction shielded from an external electromagnetic wave.

FIGS. 5A and 5B illustrate the unit cell 501 as having an I shape or an overturned H shape. However, this is exemplary and various modifications can be made to the structure of the unit cell 501. For example, the unit cell 501 may have a structure of one of the structures as illustrated in FIGS. 6A to 6E in order to have a non-resonant characteristic.

Figure 6A:
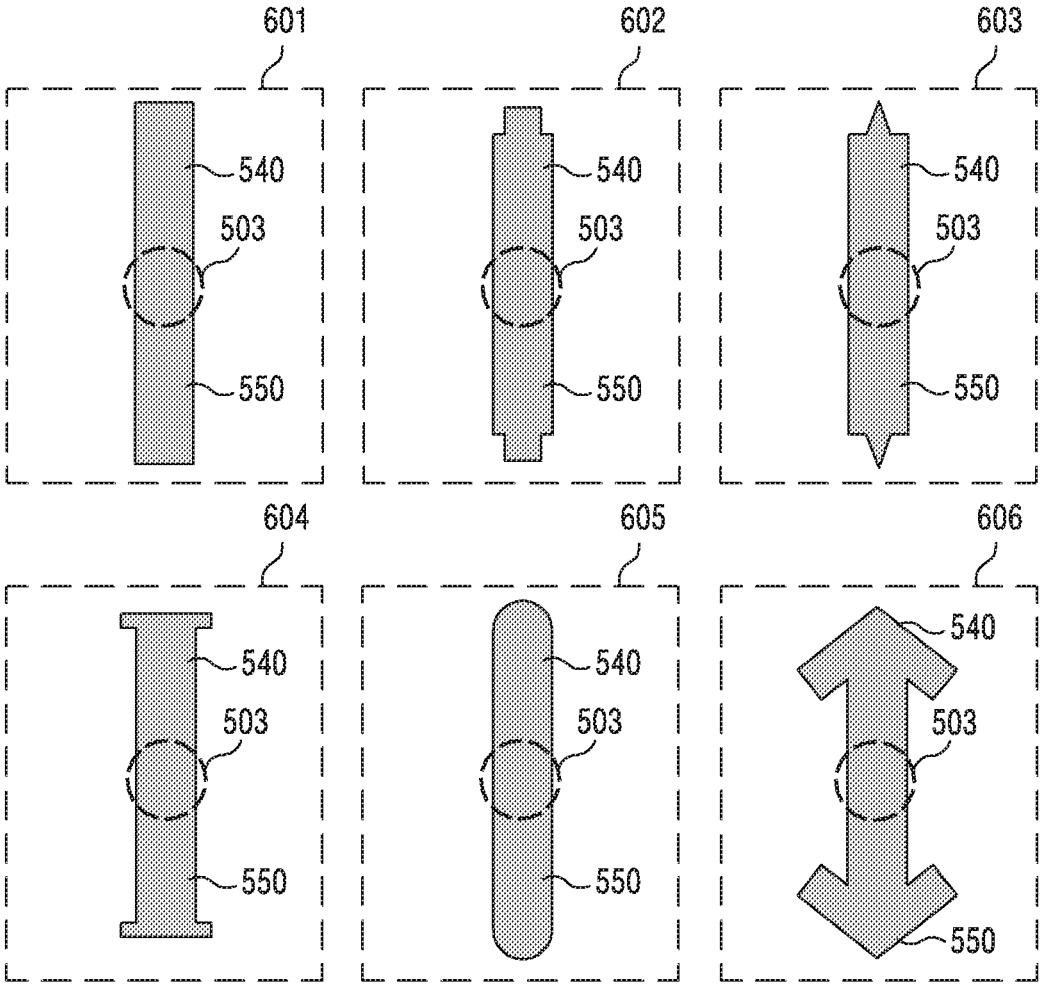
FIGS. 6A, 6B, 6C, 6D, and 6E illustrate unit cell structures according to various embodiments of the disclosure.

FIG. 6A illustrates unit cell structures according to various embodiments of the disclosure.

Referring to FIG. 6A, the structure of the unit cell 501 may be one of unit cell structures 601, 602, 603, 604, 605, and 606. For example, the structure of the unit cell 501 may be a structure in which the end portions (e.g., head portion and/or tail portion) of the first conductive member 505 and the second conductive member 507, which are not connected to the dielectric 503, have a rectangular shape (the unit cell structure 601). As another example, the structure of the unit cell 501 may be a structure in which the end portions (e.g., head portion and/or tail portion) of the first conductive member 505 and the second conductive member 507, which are not connected to the dielectric 503, are narrower than the other portions of the first conductive member 505 and the second conductive member 507 (the unit cell structure 602). As another example, the structure of the unit cell 501 may be a structure in which the end portions (e.g., head portion and/or tail portion) of the first conductive member 505 and the second conductive member 507, which are not connected to the dielectric 503, are pointed (the unit cell structure 603). As another example, the structure of the unit cell 501 may be a structure in which the end portions (e.g., head portion and/or tail portion) of the first conductive member 505 and the second conductive member 507, which are not connected to the dielectric 503, are wider than the other portions of the first conductive member 505 and the second conductive member 507 (the unit cell structure 604). As another example, the structure of the unit cell 501 may be a structure in which the end portions (e.g., head portion and/or tail portion) of the first conductive member 505 and the second conductive member 507, which are not connected to the dielectric 503, are round (the unit cell structure 605). As another example, the structure of the unit cell 501 may be a structure in which the end portions (e.g., head portion and/or tail portion) of the first conductive member 505 and the second conductive member 507, which are not connected to the dielectric 503, are in the form of an arrow (the unit cell structure 606).

Figure 6B:
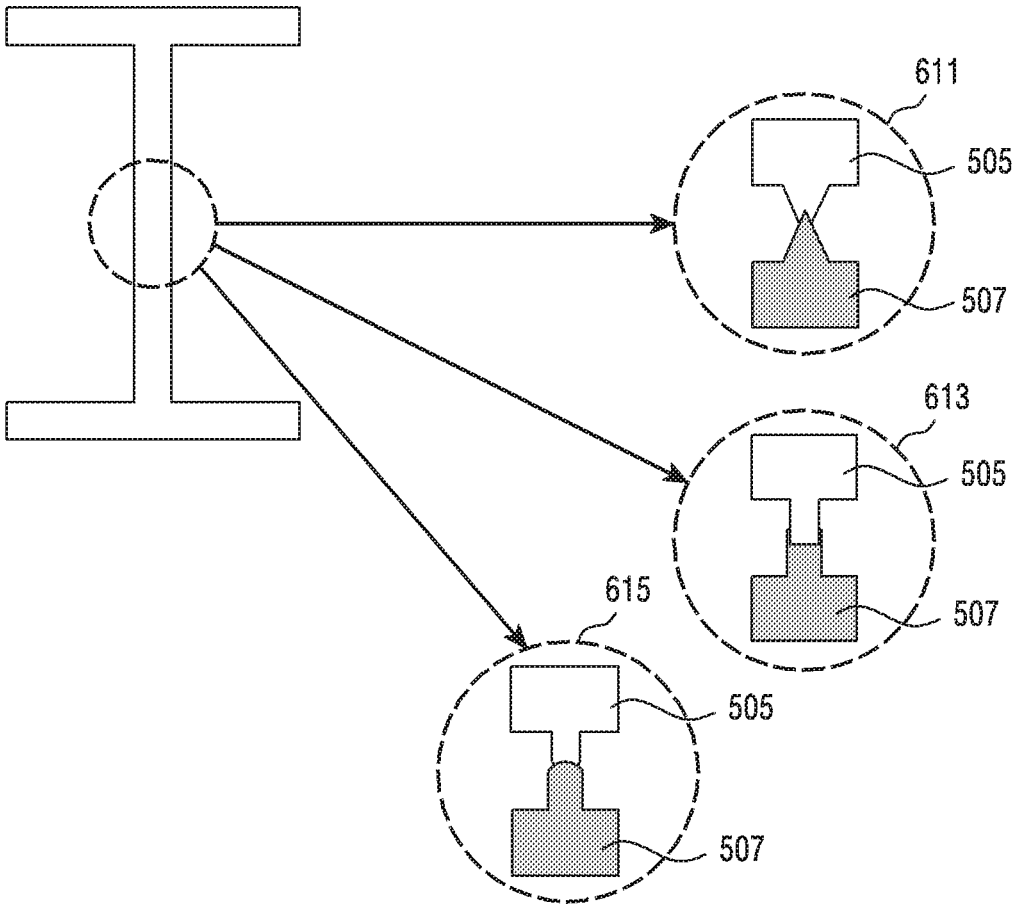

FIG. 6B illustrates other unit cell structures according to various embodiments of the disclosure. More specifically, FIG. 6B illustrates structures of a variable element conductor in a unit cell (e.g., the unit cell 501). Here, the "variable element conductor" refers to an overlapped portion in each of the first conductive member and the second conductive member in the variable capacitor region.

Referring to FIG. 6B, the structure of the variable element conductor may be one of structures 611, 613, and 615. For example, in the variable capacitor region, the variable element conductor may have a triangular shape (the structure 611), a rectangular shape (the structure 613), or a round shape (the structure 615). The structures 611, 613, and 615 of variable element conductors be varied in order to achieve appropriate electrical resistance and capacitance. The structures 611, 613, and 615 of such variable element conductors are exemplary and various modifications are possible.

In each of the structures 611, 613, and 615, it is illustrated that the variable element conductor of the second conductive member 507 overlaps the variable element conductor of the first conductive member 505 below (or above) the variable element conductor of the first conductive member 505. However, this is exemplary, and the variable element conductor of the first conductive member 505 may overlap the variable element conductor of the second conductive member 507 below (or above) the variable element conductor of the second conductive member 507.

According to FIG. 6B, the width of the variable element conductors in the unit cell may be narrower than the width of the waist portion of the unit cell. However, this is exemplary and the width of the variable element conductors in the unit cell may be wider than the width of the waist portion of the unit cell.

Figure 6C:
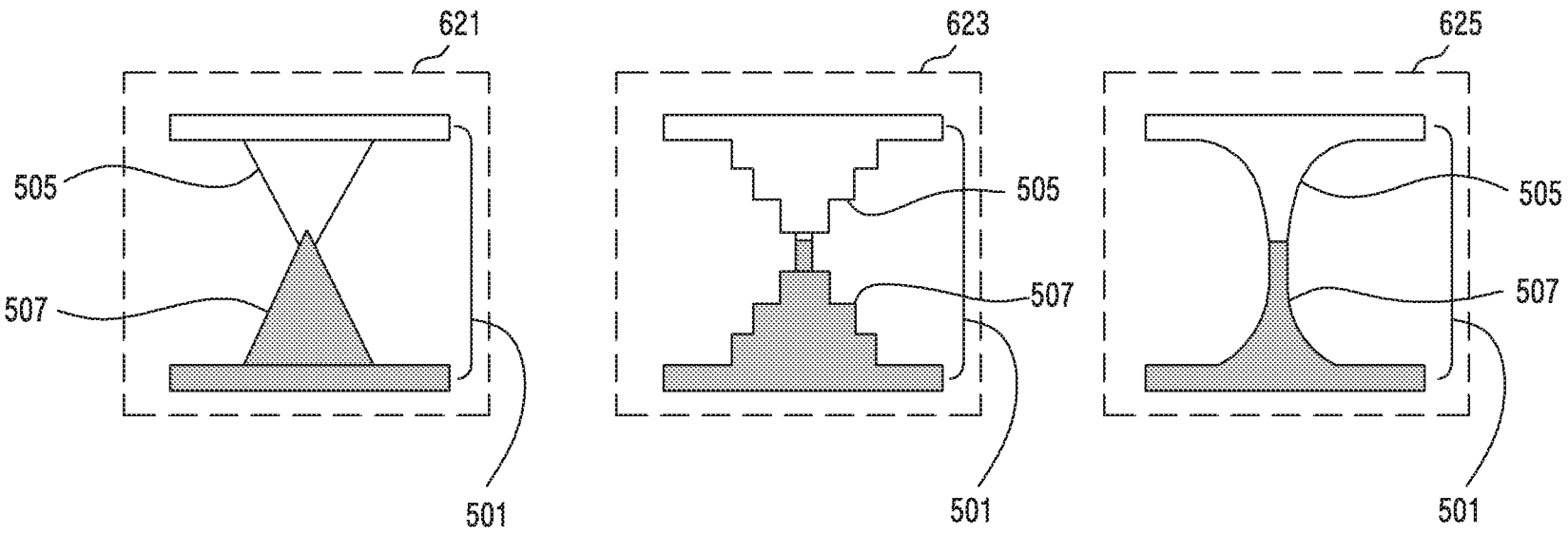

FIG. 6C illustrates other unit cell structures according to various embodiments of the disclosure. More specifically, FIG. 6C illustrates structures of waist portions in a unit cell (e.g., the unit cell 501).

Referring to FIG. 6C, the structure of a waist portion may be one of structures 621, 623, and 625. For example, the portion of each of the first conductive member 505 and the second conductive member 507 corresponding to the waist portion may have a triangular shape (the structure 621), a shape in which the widths of rectangular structures are reduced toward the variable element conductor (the structure 623), or a shape in which the portion is in a rounded shape (structure 625). Through such modifications of the structure of the waist portion, the electrical resistance of the unit cell 501 can be adaptively set.

Figure 6D:
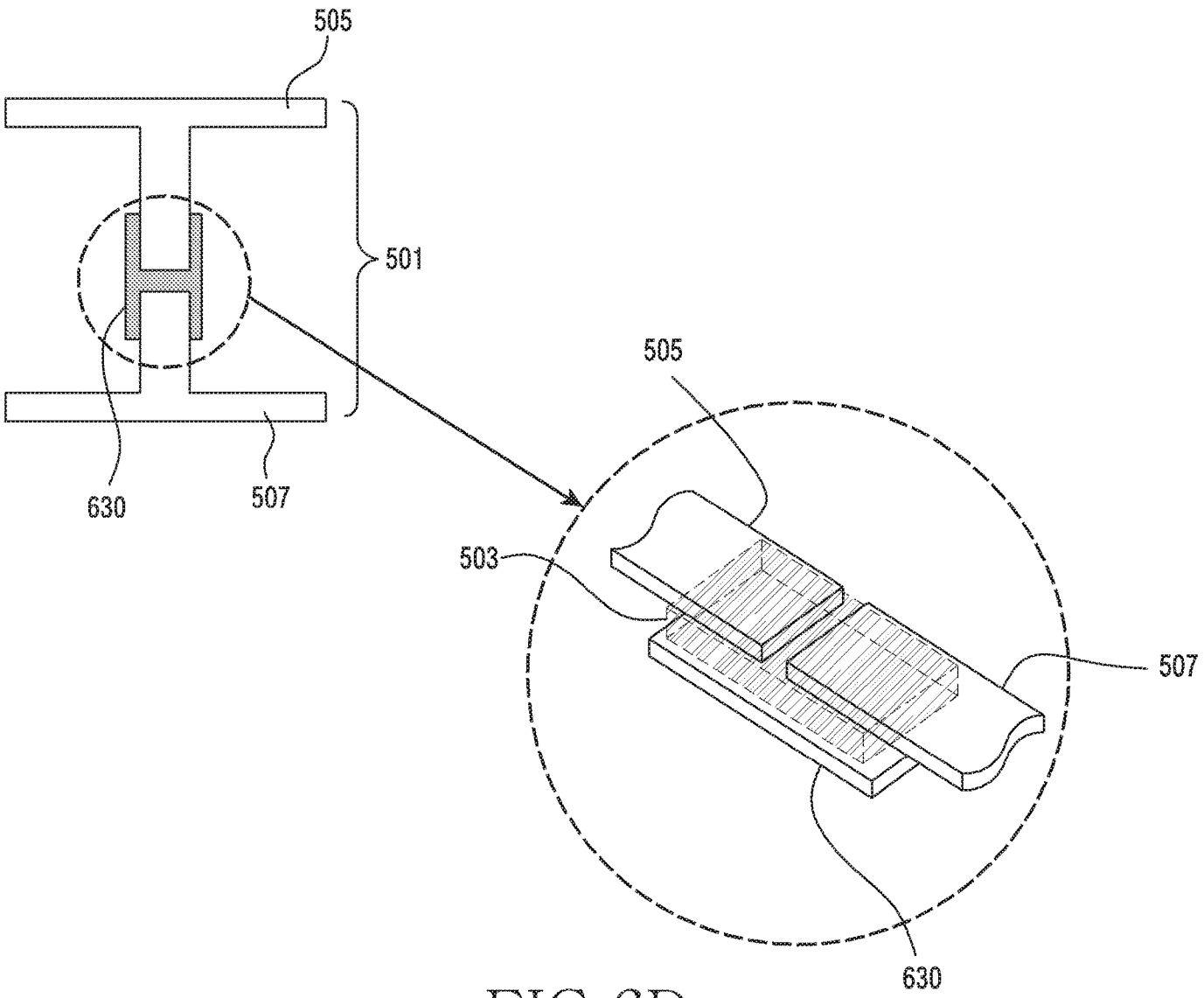
Figure 6E:
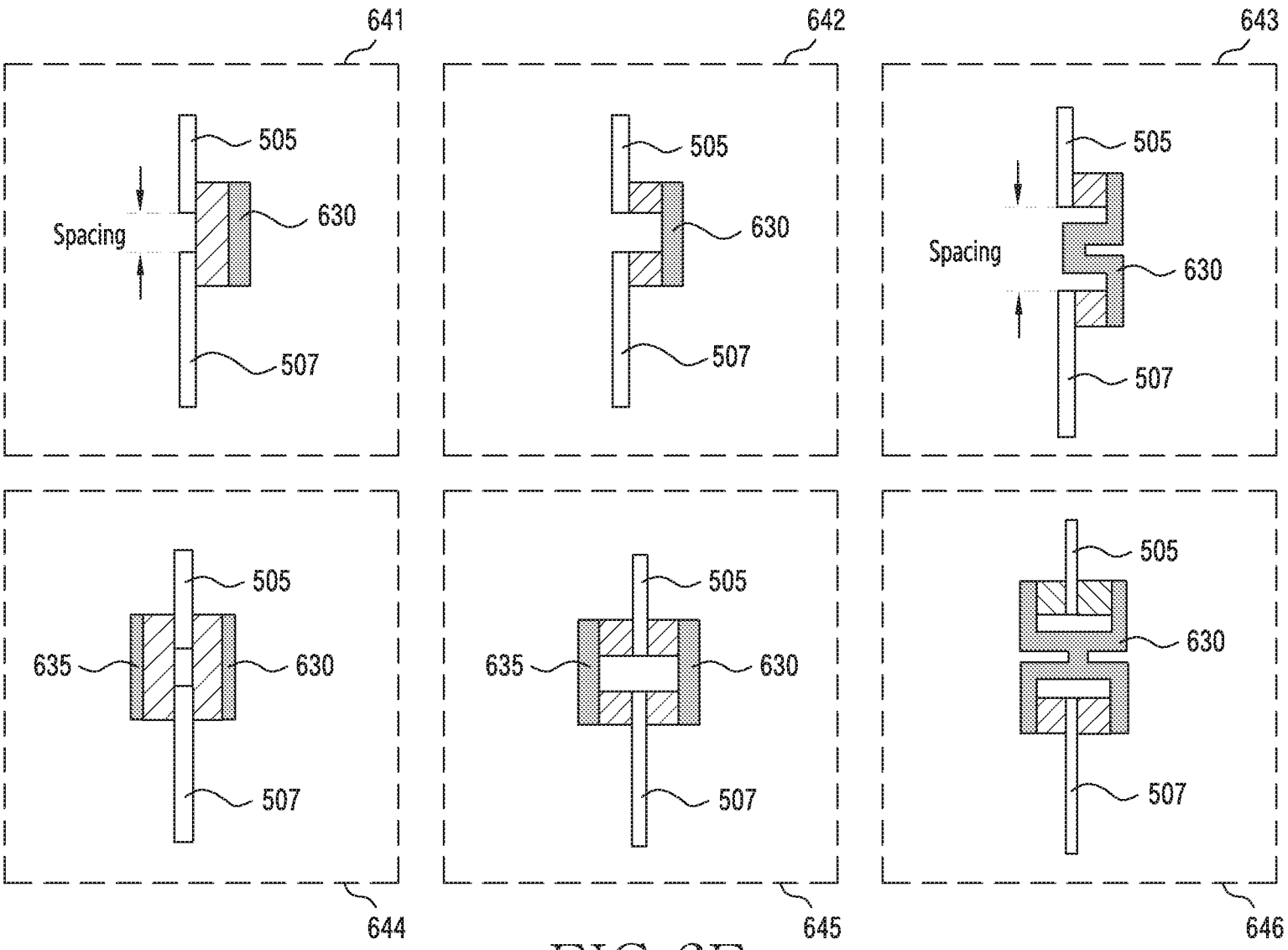

FIGS. 6D and 6E illustrate other unit cell structures according to various embodiments of the disclosure. FIG. 6D illustrates a perspective view of a unit cell 501, and FIG. 6E illustrates a side view of a unit cell 501. The other unit cells of the lens 250 may also have the same structure as the unit cell 501 described below.

Referring to FIGS. 6D and 6E, the unit cell 501 may include a third conductive member 630 (or a fourth conductive member 635 in some cases), in addition to the first conductive member 505 and the second conductive member 507. In other words, because the unit cell 501 is capable of operating properly even when a plurality of variable capacitor regions are formed in one unit cell 501, a unit cell structure including a plurality of conductive members can be applied, and the degree of freedom of design can be increased.

Referring to the unit cell structure 641 of FIGS. 6D and 6E, the unit cell 501 may include a first conductive member 505, a second conductive member 507 spaced apart from the first conductive member 505, at least a portion of the first conductive member 505, a third conductive member 630 disposed in a manner of overlapping at least a portion of the first conductive member 505 and at least a portion of the second conductive member 507 and spaced apart from the first conductive member 505 and the second conductive member 507, and a dielectric 503 interposed between the overlapped portions of the first conductive member 505 and the third conductive member 630 and interposed between the overlapped portions of the second conductive member 507 and the third conductive member 630. Accordingly, the unit cell 501 having the structure 641 of FIG. 6E may include two variable capacitor regions. Here, the two variable capacitor regions of the unit cell 501 are arranged in a direction shielded from an external electromagnetic wave.

According to various embodiments of the disclosure, the unit cell 501 may have the same structure as the unit cell structure 642. In other words, the unit cell 501 may include a first conductive member 505, a second conductive member 507 spaced apart from the first conductive member 505, at least a portion of the first conductive member 505, a third conductive member 630 disposed in a manner of overlapping at least a portion of the first conductive member 505 and at least a portion of the conductive member 507 and spaced apart from the first conductive member 505 and the second conductive member 507, a first dielectric interposed between the overlapped portions of the first conductive member 505 and the third conductive member 630, and a second dielectric interposed between the overlapped portions of the second conductive member 507 and the third conductive member 630. Accordingly, the unit cell 501 having the structure 642 may include two variable capacitor regions. Here, the two variable capacitor regions of the unit cell 501 are arranged in a direction shielded from an external electromagnetic wave.

According to various embodiments of the disclosure, the unit cell 501 may have the same structure as the unit cell structure 643. The unit cell structure 643 is a structure in which at least a portion of the third conductive member 630 in the unit cell structure 642 is disposed to overlap the spacing between the first conductive member 505 and the second conductive member. Accordingly, the unit cell 501 having the structure 643 may include two variable capacitor regions. Here, the two variable capacitor regions of the unit cell 501 are arranged in a direction shielded from an external electromagnetic wave.

According to various embodiments of the disclosure, the unit cell 501 may have the same structure as the unit cell structure 644. The unit cell structure 644 is a bilaterally symmetrical structure of the unit cell structure 641, and the unit cell 501 having the unit cell structure 644 may further include a fourth conductive member 635. In other words, the lens 250 of the unit cell structure 644 may be symmetrical in the front and back sides. Accordingly, the unit cell 501 having the structure 644 may include four variable capacitor regions. Here, the four variable capacitor regions of the unit cell 501 are arranged in a direction shielded from an external electromagnetic wave.

According to various embodiments of the disclosure, the unit cell 501 may have the same structure as the unit cell structure 645. The unit cell structure 645 is a symmetrical structure of the unit cell structure 642, and the unit cell 501 having the unit cell structure 645 may further include a fourth conductive member 635. In other words, the lens 250 of the unit cell structure 645 may be symmetrical in the front and back sides. Accordingly, the unit cell 501 having the structure 645 may include four variable capacitor regions. Here, the four variable capacitor regions of the unit cell 501 are arranged in a direction shielded from an external electromagnetic wave.

According to various embodiments of the disclosure, the unit cell 501 may have the same structure as the unit cell structure 646. The unit cell structure 646 is a bilaterally symmetrical structure of the unit cell structure 643, and the unit cell 501 having the unit cell structure 646 may further include a fourth conductive member 635. Accordingly, the unit cell 501 having the structure 646 may include four variable capacitor regions. Here, the four variable capacitor regions of the unit cell 501 are arranged in a direction shielded from an external electromagnetic wave.

FIGS. 6D and 6E illustrate unit cells including a plurality of conductive members, in which each the unit cells includes three conductive members, as an example. However, a unit cell may include N conductive members in which N is arbitrary. In this case, a unit cell including N conductive members may form M variable capacitor regions (M=N).

When a unit cell includes a plurality of conductive members, at least two of the plurality of conductive members may be controlled by the same control wire in terms of control. In other words, some of physically separated conductive members may be electrically connected. When at least two of the plurality of conductive members are controlled by the same control wire, the complexity of control wires can be reduced.

When a unit cell includes a plurality of conductive members, the complexity may be increased. However, the degree of freedom of design for designing the total capacitance value of the unit cell (e.g., the shape of variable conductive elements) can be increased. Further, the predetermine indicators (e.g., an operating frequency and a variable phase change amount) of a unit cell can be easily achieved.

As described above, the lens 250 may include at least one layer in which a plurality of unit cells are disposed, and the controller 230 may include control wires for controlling the unit cells. According to various embodiments of the disclosure, the control wires may be arranged in the form of a net like control wires for controlling unit devices in a flat panel display or memory device. For beam control through discontinuous capacitive control, the unit cell may have a maximum size of about ½ times the wavelength of an external electromagnetic wave. In other words, the unit cell should have a size smaller than or equal to about half the wavelength of an external electromagnetic wave. In this case, the interval between the wires of the net structure for controlling the unit cells may be smaller than about ½ of the wavelength of an external electromagnetic wave. However, when each interval between the control wires is equal to or less than half the wavelength of an electromagnetic wave incident on the lens 250, the electromagnetic wave may be blocked without passing through the lens 250. In other words, a wire structure in the form of a net may cause blocking of an electromagnetic wave incident on the lens 250. As a result, when the unit cells of the lens 250 are set small for sufficiently fine beam control, the intervals between the control wires for controlling the unit cells may be reduced, and thus an external electromagnetic wave may not pass through the lens 250.

Further, in order to control the capacitance of the unit cells of the lens 250 so as to change the pattern of a beam, the control signals for all unit cells of the lens 250 should temporally continue. In other words, control signals in the form of pulses cannot be used to control the unit cells of the lens 250. In the case of a display panel or a memory device, a unit image or unit memory pixel is controlled only when it is desired to store or read data in the unit image or unit memory pixel. In particular, the human eye cannot perceive flicker within about 1/30 second. Thus, in the case of a display panel, even if an image pixel actually flickers at a speed where the flicker cannot be recognized by the human (i.e., the image pixel flickers at intervals of less than 1/30) or even if the display panel displays only a portion of an image at a certain point in time, the display panel has no problem in its basic use.

However, when beamforming is performed by controlling an antenna array, a phase or latency value that individual antennas should have in order to maintain a specific beam pattern continuously should be maintained without interruption in time. For example, a final beam pattern generated by a transmission antenna is determined by the space sum of electromagnetic waves emitted from a plurality of individual antennas. Thus, when electromagnetic waves having different phases or different time delays are temporarily emitted from a specific antenna, the entire beam pattern may be distorted.

Similarly, all the unit cells of the lens 250 should also be controlled at the same time in order to produce a specific beam pattern. Therefore, individual control wires for controlling all the unit cells of the lens 250 are required. Unlike the case of an antenna array, the beam control using the lens 250 is performed when the electromagnetic waves pass through the lens 250. Thus, a control wire structure in the form of a network structure may shield electromagnetic waves, thereby making the beam control difficult.

Accordingly, various embodiments of the disclosure suggest a control wire structure for preventing the lens 250 from shielding an external electromagnetic wave, which will be described in more detail below with reference to FIGS. 7 to 11.

Figure 7:
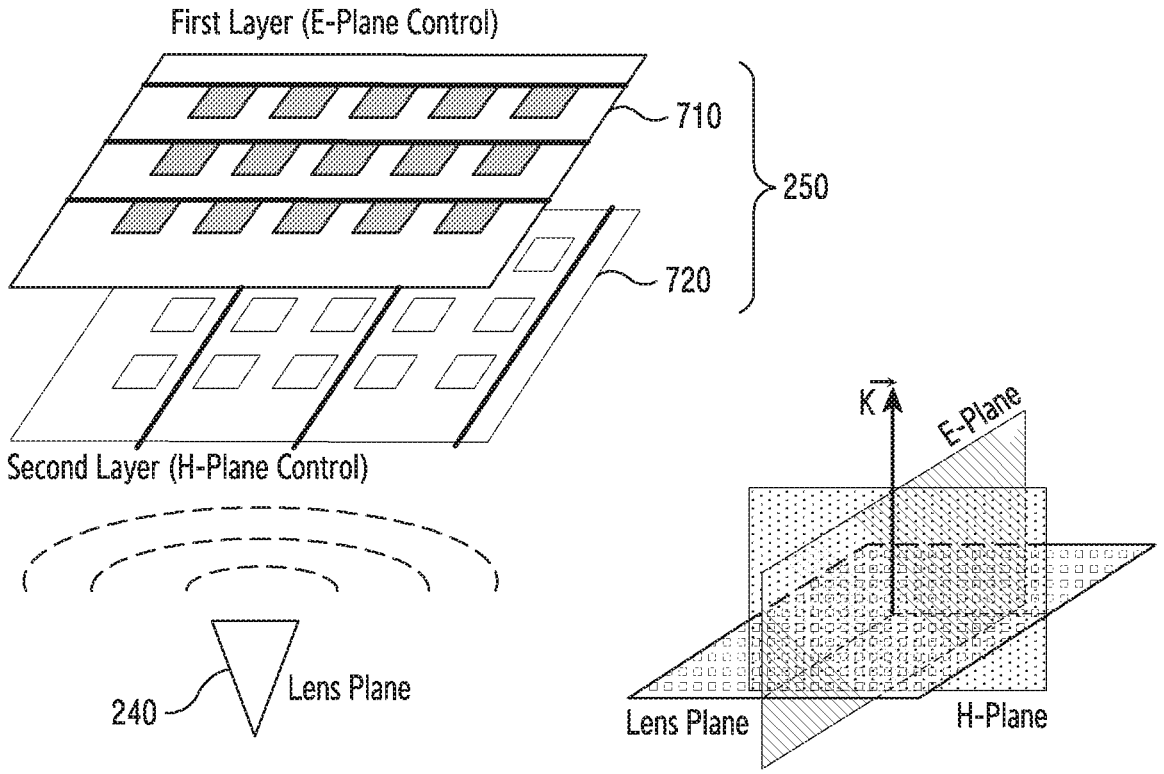
FIG. 7 illustrates a layout of control wires for controlling unit cells according to an embodiment of the disclosure.

FIG. 7 illustrates a layout of control wires for controlling unit cells according to an embodiment of the disclosure.

Referring to FIG. 7, the lens 250 may include an E-plane control layer 710 and an H-plane control layer 720. Here, the E-plane control layer 710 may include at least one of control wires (hereinafter, referred to as "E-plane control wires") and unit cells for controlling the angle of an electromagnetic wave incident on the lens 250 with respect to the E-plane, and the H-plane control layer 720 may include at least one of control wires (hereinafter, referred to as "H-plane control wires") and unit cells for controlling the angle of an electromagnetic wave incident on the lens 250 with respect to the H-plane. In other words, each of the angle of an electromagnetic wave incident on the lens 250 with respect to the E-plane and the angle of an electromagnetic wave with respect to the H-plane may be independently controlled in different layers (the E-plane control layer 710 and the H-plane control layer 720), and arbitrary beam pattern generation may be implemented through the individual control of the E plane and the H plane, which are orthogonal to each other.

As another example, the E-plane control layer 710 may include E-plane control wires, the H-plane control layer 720 may include H-plane control wires, and the lens 250 may include at least one separate unit cell layer. Here, the "unit cell layer" may refer to a layer including a plurality of unit cells. In this case, each unit cell of the unit cell layer may be controlled by the control wires of the E-plane control layer 710 such that the angle of an electromagnetic wave incident on the lens 250 with respect to the E-plane is controlled, and may also be controlled by the control wires of the control layer 720 such that the angle of an electromagnetic wave incident on the lens 250 with respect to the H-plane is controlled. In other words, the angle of an electromagnetic wave incident on the lens 250 with respect to the E-plane and the angle of an electromagnetic wave incident on the lens 250 with respect to the H-plane can be controlled all at once in a single unit cell layer.

In the E-plane control layer 710, the control wires may be horizontally disposed in order to control the unit cells on the same horizontal line, and the controller 230 may control the unit cells of the E-plane control layer 710 through the control wires so as to control the angle of a beam incident on the lens 250 with respect to the E-plane. In the H-plane control layer 720, the control wires may be vertically disposed in order to control the unit cells on the same vertical line, and the controller 230 may control the unit cells of the H-plane control layer 720 through the control wires so as to control the angle of a beam incident on the lens 250 with respect to the H-plane. In various embodiments of the disclosure, the terms "horizontal" and "vertical" are used in order to indicate relative layout directions between the control wires, rather than meaning absolute directions. Through this, beam control in the two-dimensional lens 250 can be simplified to one-dimensional beam control through each of the E-plane control layer 710 and the H-plane control layer 720, and the number of control wires required in each of the E-plane control layer 710 and the H-plane control layer 720 can be reduced. Further, a control wire structure in the form of a net can be avoided in each layer.

A process in which a beam pattern generated by the antenna 240 is controlled is as follows. First, a beam (or electromagnetic wave) generated by the antenna 240 is incident on the H-plane control layer 720 of the lens 250. As the incident beam passes through the H-plane control layer 720, the angle of the beam with respect to the H-plane can be controlled or changed as desired. Next, the beam, which has passed through the H-plane control layer 720, is incident on the E-plane control layer 710. As the incident beam passes through the E-plane control layer 710, the angle of the beam with respect to the E-plane can be controlled or changed as desired. The final beam pattern is determined based on the angle of the beam with respect to the E-plane and the angle of the beam with respect to the H-plane, and thus, the beam can be controlled in a desired pattern by passing through the E-plane control layer 710 and the H-plane control layer 720.

Referring to FIG. 7, the lens 250 includes one E-plane control layer 710 and one H-plane control layer 720. However, this is exemplary, and lens 250 may include a plurality of E-plane control layers and a plurality of H-plane control layers. In addition, FIG. 7 illustrates the control wires of the E-plane control layer 710 and the control wires of the H-plane control layer 720 as being orthogonal to each other. However, this is exemplary, and the direction of the control wires and the layout of the unit cells may be variously changed.

The layout of the control wires in the E-plane control layer 710 will be described in more detail in FIGS. 8A to 8E.

FIGS. 8A through 8E illustrate layouts of control wires for controlling an angle of an external magnetic wave with respect to an E-plane according to various embodiments of the disclosure.

Referring to FIGS. 8A to 8E, the layouts of the control wires included in the E-plane control layer 710. Hereinafter, the control wires for controlling the angle of an external electromagnetic wave with respect to the E-plane will be referred to as "E-plane control wires".

According to various embodiments of the disclosure, the E-plane control wires may be disposed on an equipotential plane perpendicular to the electric field component of an external electromagnetic wave. In this case, the external electromagnetic wave passing through the E-plane control layer 710 may not be interfered by the control wires, and may not be shielded by the control wires. In other words, by disposing the E-plane control wires, which is a metal, on the equipotential plane for an external electromagnetic wave, the E-plane control wires may not interfere with the external electromagnetic waves, so that the interference or shielding problem of the electromagnetic wave can be solved.

Figure 8A:
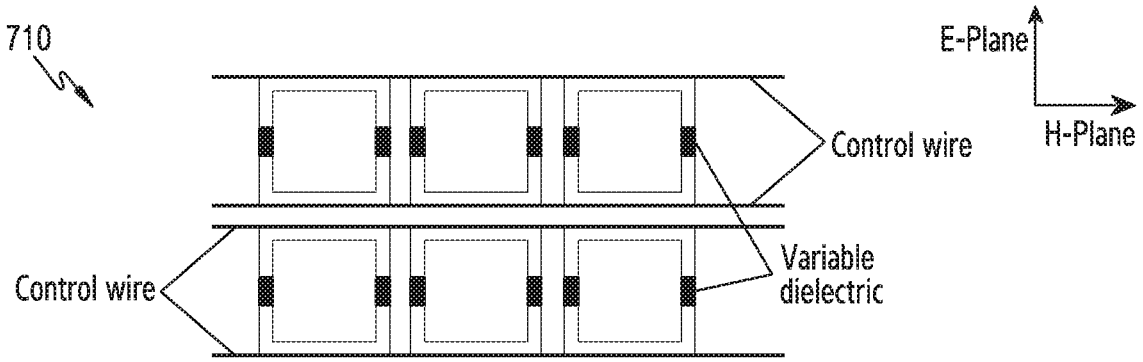
FIGS. 8A, 8B, 8C, 8D, and 8E illustrate the layouts of control wires for controlling an angle of an external electromagnetic wave with respect to an E-plane according to various embodiments of the disclosure.
Figure 8B:
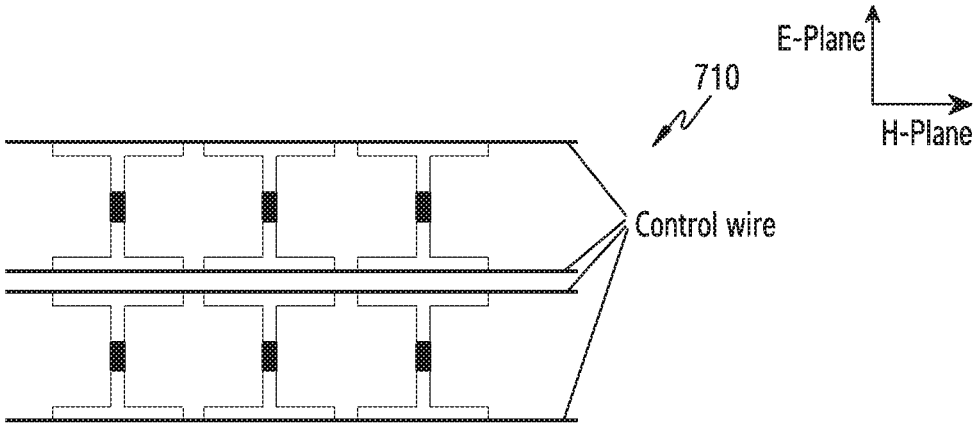
Figure 8C:
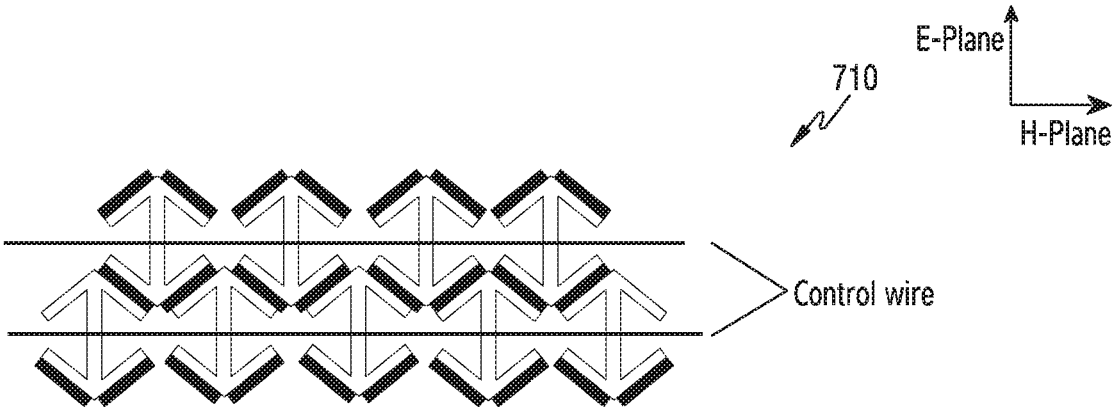
Figure 8D:
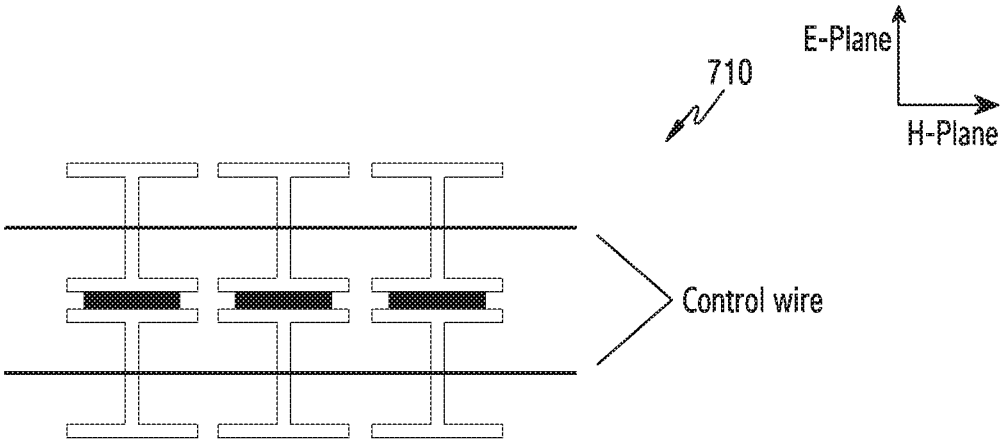
Figure 8E:
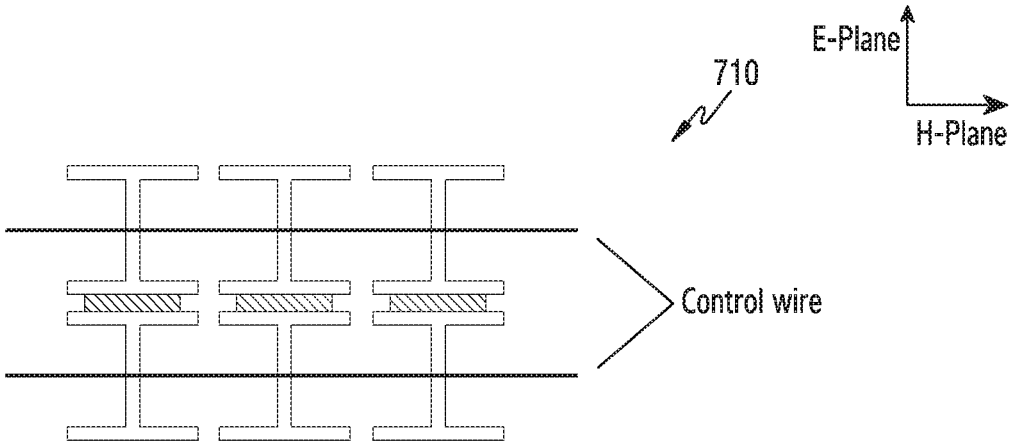

According to various embodiments of the disclosure, the equipotential plane may be formed in a line connecting the head portions of the conductors included in the unit cells, a line connecting tail portions of the conductors, or a line connecting middle portions of the conductors. For example, as illustrated in FIG. 8A, equipotential planes may be formed in lines connecting the upper head portions of the rectangular conductors included in a unit cell and connecting the lower tail portions of the conductors, and the E-plane control wires may be arranged along the equipotential planes. As another example, as illustrated in FIG. 8B, the equipotential planes may be formed in lines connecting the upper head portions of the conductors, each having an I-shaped or overturned H-shaped structure, included in the unit cell and connecting the lower tail portions of the conductors, and the E-plane control wires may be disposed along these equipotential planes. As another example, as illustrated in FIG. 8C, equipotential planes may be formed in lines connecting the middle portions of the conductors, each having the structure in the form of ⁑, included in the unit cell, and the E-plane control wires may be disposed along these equipotential planes. As another example, as illustrated in FIG. 8D, the equipotential planes may be formed in lines connecting the middle portions of the conductors, each having an I-shaped or overturned H-shaped structure, included in the unit cell, and the E-plane control wires may be disposed along these equipotential planes. As another example, as illustrated in FIG. 8E, an equipotential plane may be formed at a position where the tail portion of a conductor included any one of adjacent unit cells including conductors having an I-shaped or overturned H-shaped structure and the head portion of a conductor included in the other unit sell are adjacent to each other, and E-plane control wires may be disposed along this equipotential plane.

The layouts of control wires in the E-plane control layer 710 have been described with reference to FIGS. 8A to 8E. Hereinafter, the layouts of control wires in the H-plane control layer 720 will be described in more detail with reference to FIGS. 9A and 9B.

Figure 9A:
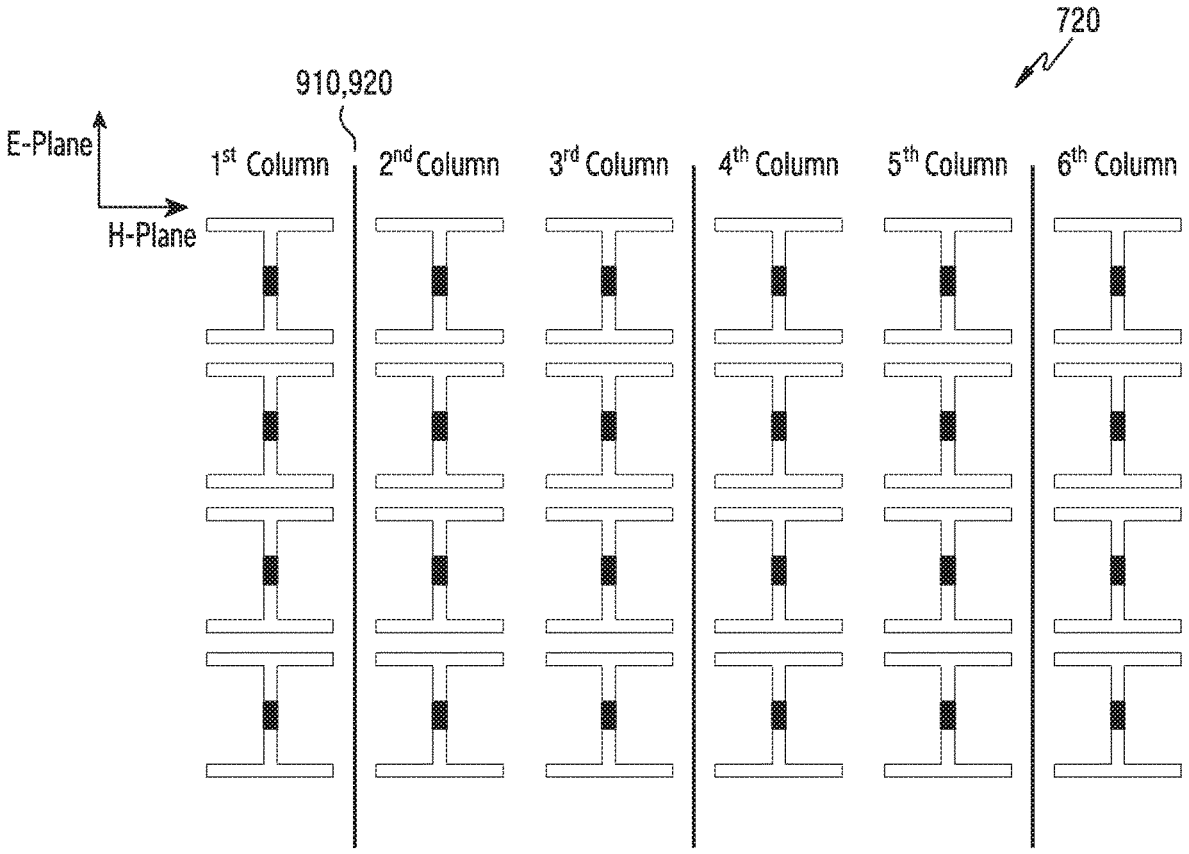
FIGS. 9A and 9B illustrate the layouts of control wires for controlling an angle of an external electromagnetic wave with respect to an H-plane according to various embodiments of the disclosure.
Figure 9B:
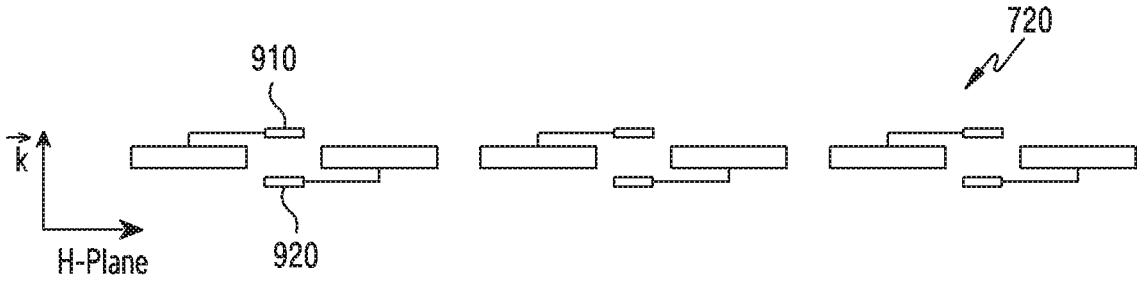

FIGS. 9A and 9B illustrate the layouts of control wires for controlling an angle of an external electromagnetic wave with respect to an H-plane according to various embodiments of the disclosure. For example, FIGS. 9A and 9B may illustrate the layouts of the control wires included in the H-plane control layer 720. Hereinafter, the control wires for controlling the angle of an external electromagnetic wave with respect to the H-plane will be referred to as "H-plane control wires".

FIG. 9A is a plan view illustrating the layout of unit cells included in the H-plane control layer 720, and FIG. 9B is a side view illustrating the layout of unit cells included in the H-plane control layer 720.

Referring to FIG. 9A, an H-plane control wire 910 for controlling unit cells belonging to a first column and an H-plane control wire 920 for controlling unit cells belonging to a second column are arranged between the first and second columns, an H-plane control wire for controlling unit cells belonging to a third column and an H-plane control wire for controlling unit cells belonging to a fourth column are arranged between the third and fourth columns, and an H-plane control wire for controlling unit cells belonging to a fifth column and an H-plane control wire for controlling unit cells belonging to a sixth column are disposed between the fifth and the sixth columns. In other words, the control wires for controlling respective groups of unit cells belonging to two adjacent columns are arranged to overlap each other. The overlap layout of the H-plane control wires can be more clearly understood with reference to FIG. 9B. Since an external electromagnetic wave is incident in a direction perpendicular to the H-plane control layer 720 (i.e., in a direction coming out from the sheet of FIG. 9A) and passes through the H-plane control layer 720, the wire interval experienced by the electromagnetic wave, which passes through the H-plane control layer 720 through the overlap layout of the wires, can be substantially increased. For example, when the size of the unit cells is ½ times of the wavelength of an external electromagnetic wave, the wire interval experienced by the electromagnetic wave, which passes through the H-plane control layer 720 through the overlap layout of the two control wires becomes one time of the wavelength, the electromagnetic wave does not have a problem in passing through the H-plane control layer 720.

According to FIGS. 9A and 9B, two H plane control wires overlap each other. However, this is exemplary, and the number of overlapped H plane control wires is not limited thereto. For example, all of the H-plane control wire 910 for controlling the unit cells belonging to the first column, the H-plane control wire 920 for controlling the unit cells belonging to the second row, the H-plane control wire for controlling the unit cells belonging to the third column 3, and the H-plane control wire for controlling the unit cells belonging to the fourth column (e.g., four control wires) may be overlappingly disposed between the third row and the fourth row. In this case, the wire interval experienced by the electromagnetic wave passing through the H-plane control layer 720 can be further increased.

Figure 10:
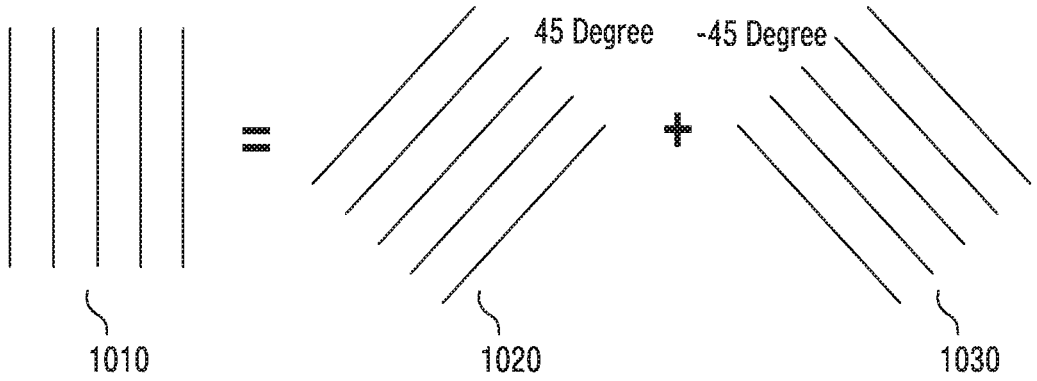
FIG. 10 illustrates control wires arranged in different directions according to an embodiment of the disclosure.

FIG. 10 illustrates control wires arranged in different directions according to an embodiment of the disclosure.

Referring to FIG. 10, the control wires in a control layer (e.g., an H-plane control layer or an E-plane control layer) included in the lens may be arranged in the vertical direction as in a layout 1010. However, instead of one control layer in which the control wires are arranged vertically, it is possible to use a plurality of layers in which control wires are arranged in different directions. For example, the overlap of an E-plane control layer in which E-plane control wires are arranged in a 45-degree direction to the right with respect to the vertical direction as in a layout 1020 and an E-plane control layer in which the E-plane control wires are arranged in a 45-degree direction to the left with respect the vertical direction (i.e., in a −45 degree direction to the right) as in a layout 1030 can have the same effect as that in the E-plane control wires arranged in the vertical direction in the one E-plane control layer. As another example, the overlap of an E-plane control layer in which H-plane control wires are arranged in a 45-degree direction to the right with respect to the vertical direction as in the layout 1020 and an H-plane control layer in which the H-plane control wires are arranged in a 45-degree direction to the left with respect the vertical direction (i.e., in a −45 degree direction to the right) as in the layout 1030 can have the same effect as that in the H-plane control wires arranged in the vertical direction in the one E-plane control layer.

In FIG. 10, the direction or angle of the control wires is exemplary, and the control wires in the overlapped control layers may be arranged in various directions and angles.

Figure 11:
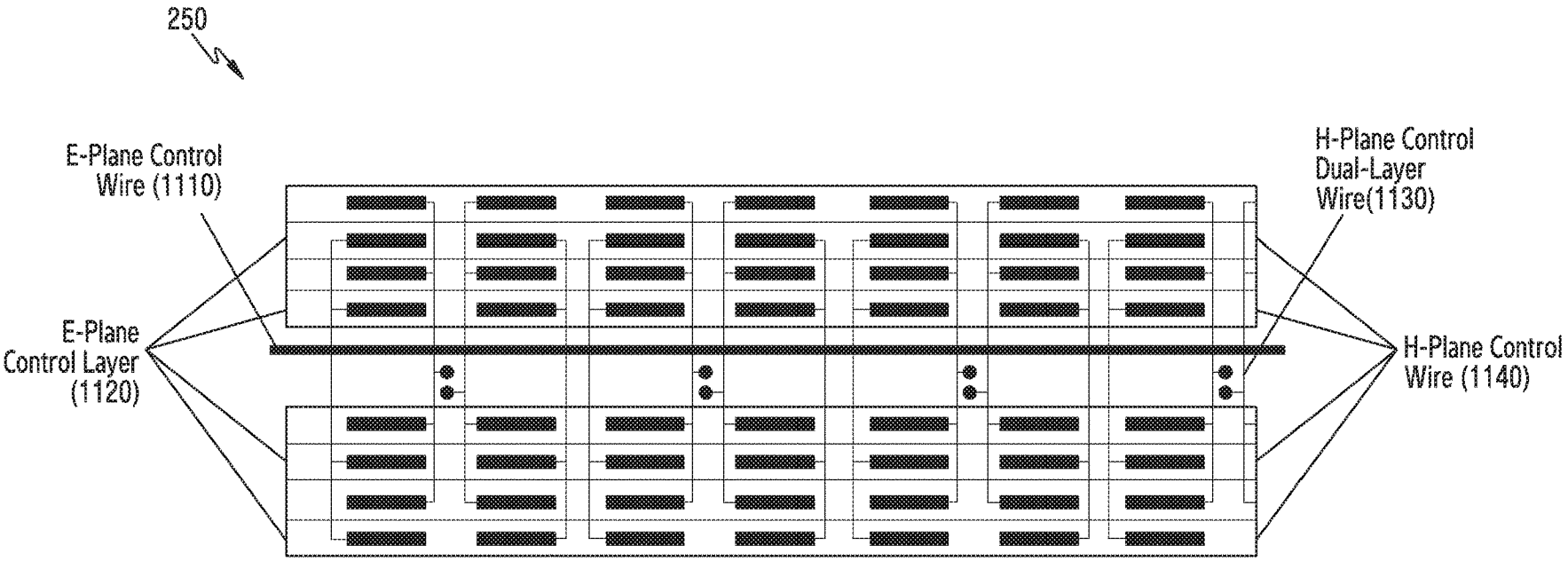
FIG. 11 illustrates a layout of control wires for controlling different layers with the same control wire according to an embodiment of the disclosure.

FIG. 11 illustrates a layout of control wires for controlling different layers with the same control wire according to various embodiments of the disclosure.

Referring to FIG. 11, the lens 250 may include four E-plane control layers 1120 and four H-plane control layers 1140. Two E-plane control layers among the four E-plane control layers 1120 and two H-plane control layers among the four H plane control layers 1140 may alternatively overlap each other so as to form an upper control layer group. The remaining two E-plane control layers among the four E-plane control layers 1120 and the remaining two H-plane control layers among the four H-plane control layers 1140 may alternately overlap each other so as to form a lower control layer group.

An E-plane control wire 1110 and an H-plane control double-layer wire 1130 may be disposed between the upper control layer group and the lower control layer group. In other words, a separate control wire layer composed only of control wires may be formed. According to various embodiments of the disclosure, the E-plane control wire 1110 may control not only unit cells belonging to one E-plane control layer, but also unit cells belonging to a plurality of E-plane control layers (e.g., four E-plane control layers 1120). Further, the H-plane control dual-layer wire 1130 may control not only unit cells belonging to one H-plane control layer, but also unit cells belonging to a plurality of H-plane control layers (e.g., four H-plane control layers 1140). According to various embodiments of the disclosure, a separate control wire layer composed only of control wires may be formed, and unit cells belonging to a plurality of E-plane or H-plane control layers may be controlled through the control wire layer.

FIG. 11 illustrates that the lens 250 includes four E-plane control layers 1120 and four H-plane control layers 1140. However, this is exemplary, and the lens 250 may include various numbers of E-plane control layers and H-plane control layers. In addition, the number of E-plane control layers included in the lens 250 and the number of H-plane control layers do not necessarily have to be the same, and the control wire layers may be inserted at various positions in the lens 250.

Figure 12:
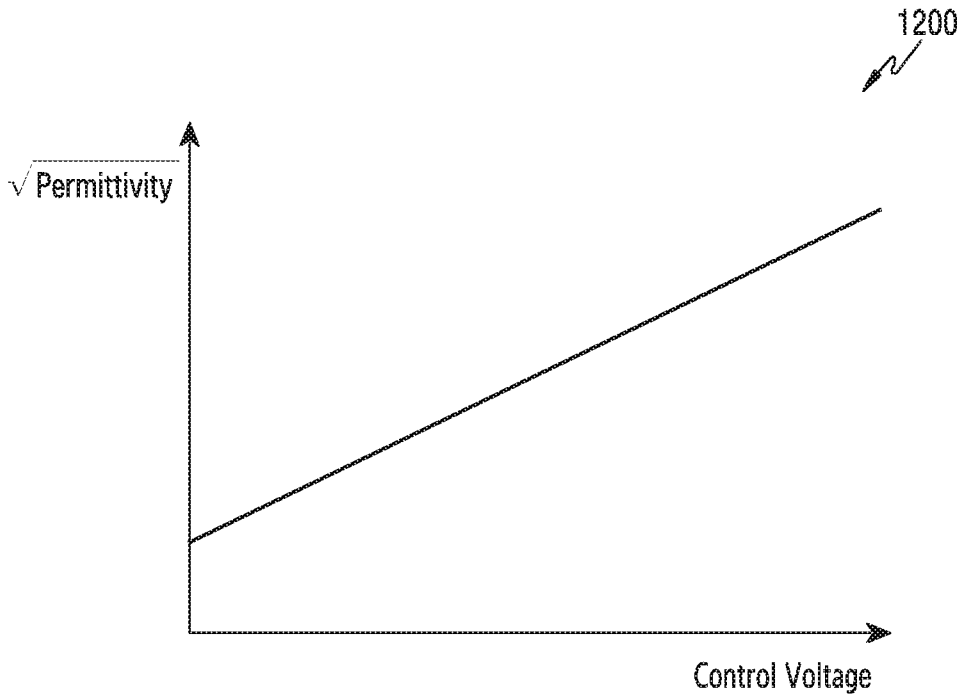
FIG. 12 illustrates a graph showing the relationship between the magnitude of a control voltage applied to a unit cell and the permittivity of the unit cell according to an embodiment of the disclosure.

FIG. 12 illustrates a graph 1200 showing the relationship between the magnitude of a control voltage applied to a unit cell and the permittivity of the unit cell according to an embodiment of the disclosure.

According to the graph 1200, the magnitude of the control voltage applied to the unit cell and the root value of the permittivity of the unit cell are proportional to each other. Based on the relationship with the graph 1200, the magnitude of the voltage to be applied to the unit cell can be determined. For example, when the permittivity of the unit cell for changing the angle of an electromagnetic wave with respect to the E-plane or the angle of an electromagnetic wave with respect to the H-plane as desired, the magnitude of the voltage to be applied to the unit cell can be determined based on the relationship as in the graph 1200.

When an electromagnetic wave incident on the lens 250 from the antenna 240 is a plane wave, the relationship between the permittivity of the unit cell through which the electromagnetic wave passes and the phase delay of the electromagnetic wave can be expressed as Equation 1 below.

$$\phi = 2\pi \frac{f\sqrt{\epsilon_r}}{c} \qquad \text{Equation 1}$$

Here, $\phi$ represents a phase delay of an electromagnetic wave passing through a unit cell having a permittivity $\varepsilon r$, f represents the frequency of the electromagnetic wave, and c represents the speed of the electromagnetic wave. According to Equation 1, the permittivity of the unit cell is related to the phase delay of the electromagnetic wave passing through the unit cell.

In order to rotate the electromagnetic wave by a specific angle $\theta$, the phase of the electromagnetic wave to be delayed in each unit cell of the lens 250 should satisfy Equation 2 below.

$$\phi(x) = \frac{2\pi(x - x_0)}{\lambda}\sin\theta \qquad \text{Equation 2}$$

Here, $x_0$ represents the position of the center of the lens 250 represents the position of a unit cell to be controlled, $\theta$ represents an angle at which it is desired to refract the electromagnetic wave with reference to a line perpendicular to the center of the lens 250, and $\lambda$ represents the wavelength of the electromagnetic wave, and $\phi(x)$ represents the phase delay of the electromagnetic wave at a position x.

As another example, a condition for causing the electromagnetic wave incident on the lens 250 to be focused on a specific focal distance after passing through the lens 250 may be expressed as Equation 3 below.

$$\phi(x) = \frac{2\pi\left(\sqrt{F_0^2 + (x - x_0)^2} - F_0\right)}{\lambda} \qquad \text{Equation 3}$$

Here, $x_0$ represents the position of the center of the lens 250, x represents the position of a unit cell to be controlled, $\lambda$ represents the wavelength of the electromagnetic wave, $\phi(x)$ represents the phase delay of the electromagnetic wave at a position x, and $F_0$ represents a distance from the center of the lens 250 to the point where the electromagnetic wave passing through the lens 250 is focused (the focal distance).

A process for determining a voltage for controlling a beam according to Equations 1 to 3 will be described in more detail below with reference to FIG. 13.

Figure 13:
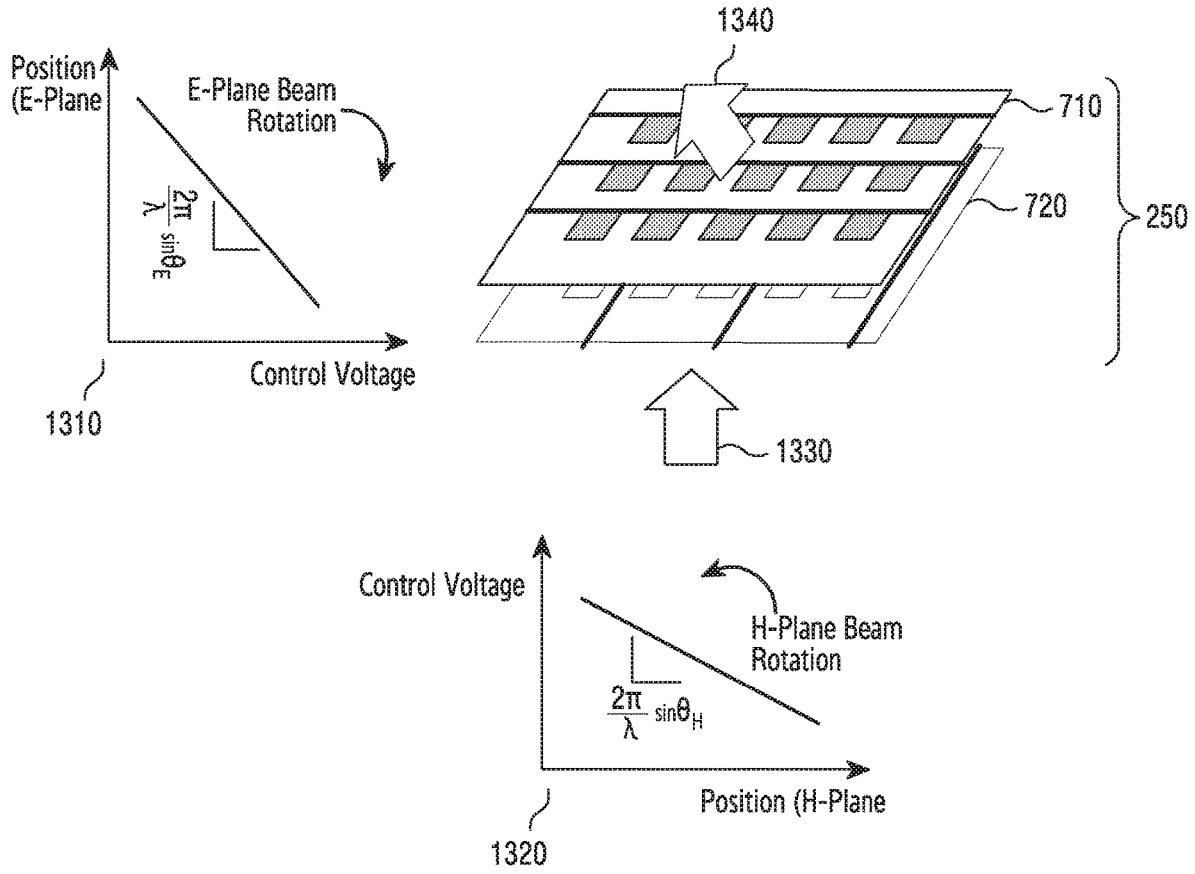
FIG. 13 illustrates a process for controlling a beam pattern based on a control voltage according to an embodiment of the disclosure.

FIG. 13 illustrates a process for controlling a beam pattern based on a control voltage according to an embodiment of the disclosure. FIG. 13 illustrates that lens 250 includes an E-plane control layer 710 and an H-plane control layer 720 for convenience of explanation. However, this is exemplary, and the number of E-plane and/or H-plane control layers and the layout of control wires in each control layer can be variously modified.

Based on Equation 1 and Equation 2, a control voltage for refracting electromagnetic wave incident on lens 250 by an angle $\theta_E$ with respect to the E-plane, and by an angle $\theta_H$ with respect to the H-plane may be expressed as Equation 4 below.

$$V_H = \frac{2\pi x_H}{\lambda}\sin\theta_H \qquad \text{Equation 4}$$

$$V_E = \frac{2\pi x_E}{\lambda}\sin\theta_E$$

Here, $\lambda$ represents the wavelength of an electromagnetic wave, $x_H$ represents the position of a unit cell to be controlled in the H-plane control layer 720 with respect to the H-plane, $\theta_H$ represents an angle at which it is desired to refract the electromagnetic wave with respect to the H-plane with reference to a line perpendicular to the center of the lens 250, $V_H$ represents the voltage to be applied to a unit cell located at $x_H$ in the H-plane control layer 720, $x_E$ represents the position of a unit cell to be controlled in the E-plane control layer 710 with respect to the E-plane, $\theta_E$ represents an angle at which it is desired refract the electromagnetic wave with respect to the H-plane with reference to a line perpendicular to the center of the lens 250, and $V_E$ represents a voltage to be applied to a unit cell located at $x_E$ in the E-plane control layer 710.

According to Equation 4, in order to refract an electromagnetic wave incident on the lens 250 by an angle $\theta_E$ with respect to the E-plane, the relationship between the position $x_E$ of a unit cell in the E-plane control layer 710 with respect to the E-plane and a voltage $V_E$ to be applied to the unit cell may be expressed as a graph 1310. In addition, in order to refract an electromagnetic wave incident on the lens 250 by an angle $\theta_H$ with respect to the H-plane, the relationship between the position $x_H$ of a unit cell in the H-plane control layer 720 with respect to the H-plane and a voltage $V_H$ to be applied to the unit cell may be expressed as a graph 1320. In other words, the controller 230 can control a refractive index of at least one unit cell among a plurality of unit cells of the lens 250 by applying a voltage (or, an external control signal for applying the voltage), which is determined based on a position of the at least one unit cell, to the at least one unit cell, and can control a refractive index of at least one unit cell among the plurality of unit cells by an external control signal based on a position of the at least one unit cell. When the control voltage for the unit cell is applied to satisfy Equation 4 in the E-plane control layer 710 and the H-plane control layer 720, the electromagnetic wave incident on the lens 250 in a direction 1330 are refracted by an angle $\theta_E$ with respect to the E-plane and by an angle $\theta_H$ with respect to the H-plane, so that the electromagnetic wave can propagate in a direction 1340 after passing through the lens 250.

As another example, a control voltage for causing the electromagnetic wave incident on the lens 250 to be focused on a specific focal distance after passing through the lens 250 can be determined according to Equation 5 below.

$$V_H(x_H) = \frac{2\pi\left(\sqrt{F_0^2 + (x_H - x_{H,0})^2} - F_0\right)}{\lambda} \qquad \text{Equation 5}$$

$$V_E(x_E) = \frac{2\pi\left(\sqrt{F_0^2 + (x_E - x_{E,0})^2} - F_0\right)}{\lambda}$$

Here, $x_{H,0}$ represents the position of the center of the lens 250 with respect to the H-plane, $x_H$ represents the position of a unit sell to be controlled in the H-plane control layer 720 with respect to the H-plane, $\lambda$ represents the wavelength of the electromagnetic wave, $F_0$ represents a distance from the center of the lens 250 to a point at which the electromagnetic wave passing through the lens 250 is focused) (focal distance), $V_H(x_H)$ represents a voltage to be applied to a unit cell located at $x_H$ in the H-plane control layer 720, $x_{E,0}$ represents the position of the center of the lens 250 with respect to the E-plane, $x_E$ represents the position of a unit cell to be controlled in the E-plane control layer 710 with respect to the E-plane, and $V_E(x_E)$ represents a voltage to be applied to a unit cell located at $x_E$ in the E-plane control layer 710.

The operation of the communication device A 110 according to various embodiments of the disclosure will now be described with reference to FIGS. 14 and 15.

Figure 14:
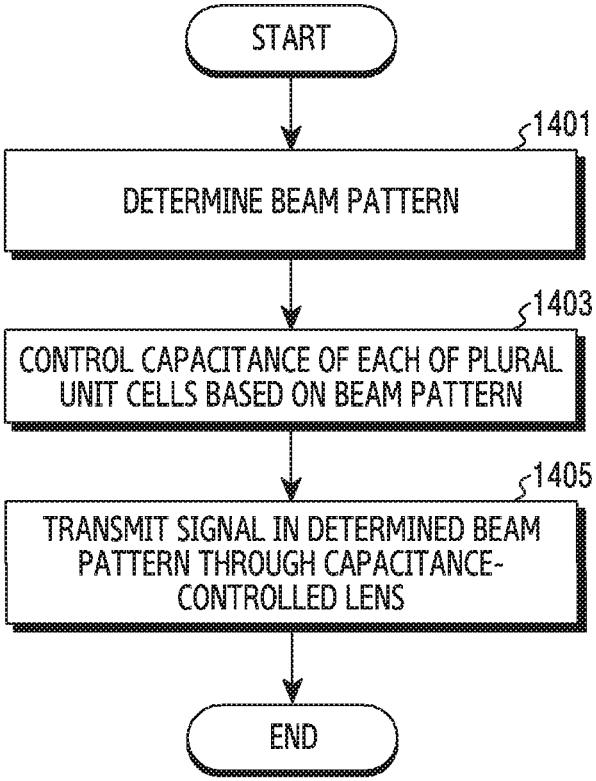
FIG. 14 illustrates a flowchart for controlling a beam pattern according to an embodiment of the disclosure.

FIG. 14 illustrates a flowchart for controlling a beam pattern according to an embodiment of the disclosure. FIG. 14 illustrates an operation of the communication device A101 as an example.

Referring to FIG. 14, in operation 1401, the controller 230 determines a beam pattern. The beam pattern means a pattern of a beam passing through the lens 250. The beam pattern may include at least one of the direction and width of a beam. In order to determine a beam pattern, the controller 230 may determine an angle at which the beam incident on the lens 250 should be deflected with respect to the H-plane (H-plane control angle) and an angle at which the beam incident on the lens 250 should be deflected with respect to the E-plane (E-plane control angle).

In operation 1403, the controller 230 controls the capacitance of each of the plurality of unit cells based on the determined beam pattern. For example, the controller 230 controls the capacitance of the unit cells by applying a voltage, which is determined by Equation 4 depending on the position of the unit cells in the E-plane control layer and the H-plane control layer of the lens 250, to the unit cells.

In operation 1405, the controller 230 controls the communication unit 210 to transmit a signal in the determined beam pattern, through the lens 250, the capacitance of which is controlled. For example, when the communication unit 210 inputs a beam to the lens 250, the capacitance of which is controlled as in operation 1403, the incident beam is refracted while passing through the lens 250 so as to have a beam pattern determined as in operation 1401.

According to various embodiments of the disclosure, a unit cell includes a first conductive member, a second conductive member disposed in a manner of overlapping at least a portion of the first conductive member and spaced apart from the first conductive member, and a dielectric interposed between the overlapped portions of the first conductive member and the second conductive member. Here, the overlap region of the first conductive member and the second conductive member is arranged in a direction shielded from an external electromagnetic wave.

Figure 15:
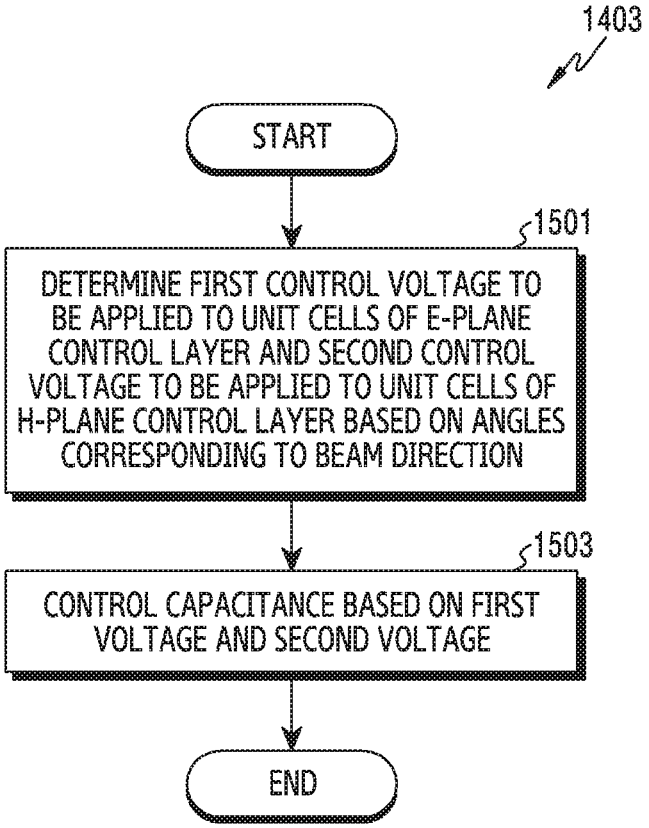
FIG. 15 illustrates a flowchart for independently controlling the angle of an external electromagnetic wave with respect to an E-plane and the angle of an external electromagnetic wave with respect to an H-plane based on a control voltage according to an embodiment of the disclosure.

FIG. 15 illustrates a flowchart for independently controlling the angle of an external electromagnetic wave with respect to an E-plane and the angle of an external electromagnetic wave with respect to an H-plane based on a control voltage according to an embodiment of the disclosure. FIG. 15 illustrates an operation of the communication device A101 as an example.

Referring to FIG. 15, in operation 1501, the controller 230 determines a first control voltage to be applied to the E-plane control layer based on an E-plane control angle corresponding to a beam pattern, and a second control voltage to be applied to the H-plane control layer based on an H-plane control angle corresponding to the beam pattern. Here, the E-plane control angle means an angle at which a beam incident on the lens 250 should be refracted with respect to the E-plane in order to have a specific beam pattern after passing through the lens 250, and the H-plane control angle means an angle at which a beam incident on the lens 250 should be refracted with respect to the H-plane in order to have the beam pattern after passing through the lens 250. The controller 230 may determine a voltage to be applied to the unit cells (the first control voltage) using Equation 4 depending on the position of the unit cells with respect to the E-plane in the E-plane control layer. In addition, the controller 230 may determine a voltage to be applied to the unit cells (the second control voltage) using Equation 4 depending on the position of the unit cells with respect to the H-plane in the H-plane control layer.

In operation 1503, the controller 230 controls the capacitance of the unit cells based on the first voltage and the second voltage. For example, the controller 230 may control the capacitance of the E-plane control layer by applying the first control voltage to the E-plane control layer, and may control the capacitance of the H-plane control layer by applying the second control voltage to the H-plane control layer. As described above, the lens 250 includes an E-plane control layer for controlling the angle of an electromagnetic wave incident on the lens 250 with respect to the E-plane, and an H-plane control layer for controlling the angle of an electromagnetic wave with respect to the H-plane, and the angles of the electromagnetic wave incident on the lens 250 with respect to the E-plane and the H-plane can be individually controlled by the first control voltage and the second control voltage. Accordingly, by disposing control wires for controlling the angle of an electromagnetic wave incident on the lens 250 with respect to the E-plane and control wires for controlling the angle of an electromagnetic wave incident on the lens 250 with respect to the H-plane in separate layers, it is possible to avoid that the control wires have a network structure and to ensure that an external electromagnetic wave is not shielded by the control wires.

Figure 16:
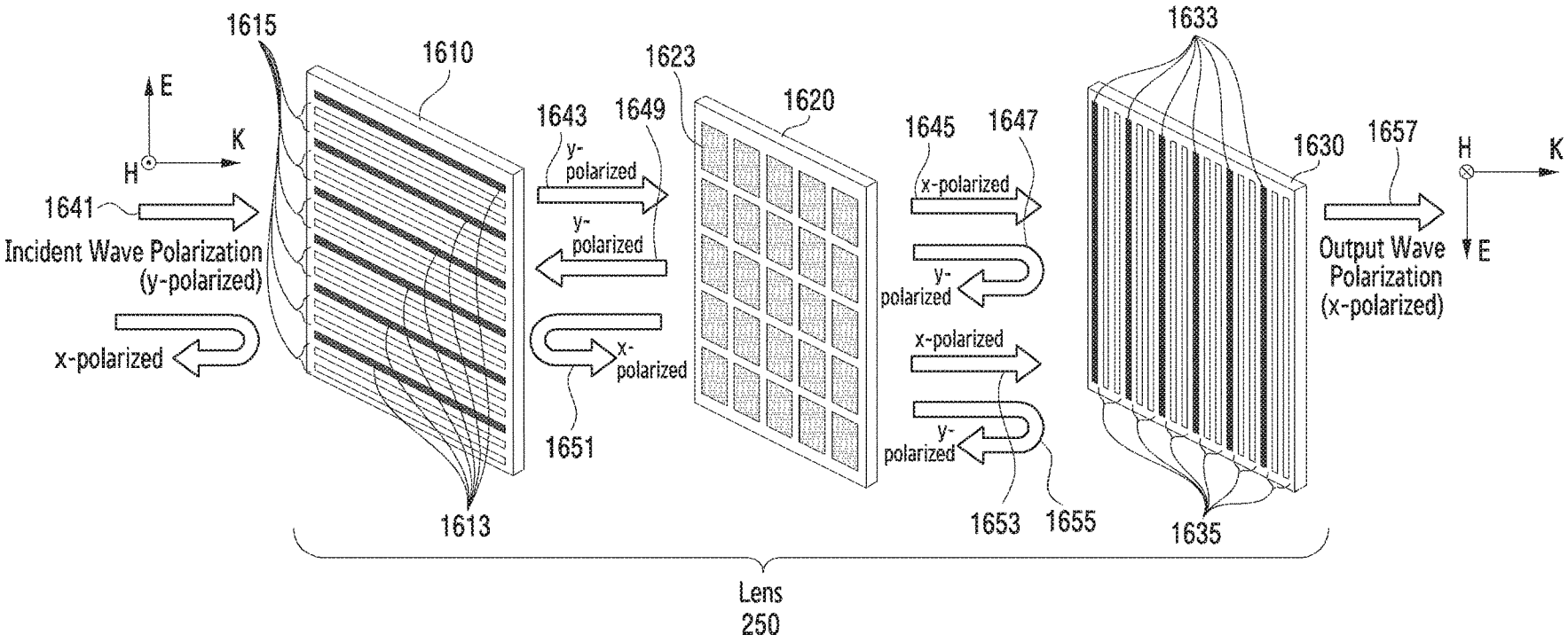
FIG. 16 illustrates an example of a case in which polarization conversion of an electromagnetic wave occurs in a lens according to an embodiment of the disclosure.

FIG. 16 illustrates an example of a case in which polarization conversion of an electromagnetic wave occurs in a lens 250 according to various embodiments of the disclosure.

Referring to FIG. 16, the lens 250 may include an E-plane control layer 1610, a unit cell layer 1620, and an H-plane control layer 1630.

The E-plane control layer 1610 may include E-plane control wires 1613 and dummy wires 1615. Here, the dummy wires 1615 are included in the E-plane control layer 1610, but unlike the E-plane control wires, the dummy wires 1615 may not be used to control the angle of an electromagnetic wave incident on the lens 250 with respect to the E-plane. In other words, the dummy wires 1615 are not electrically connected to the unit cells of the unit cell layer 1620 and may not be used to control the unit cells. Each of the dummy wires 1615 may be disposed between at least two E-plane control wires among the E-plane control wires 1613. In the E-plane control layer 1610, the wires may be arranged parallel to each other.

According to various embodiments of the disclosure, the dummy wires 1615 may be disposed such that the interval between adjacent wires in the E-plane control layer 1610 is equal to or less than a predetermined interval. Since the interval between adjacent wires in the E-plane control layer 1610 is equal to or less than the predetermined interval, the E-plane control layer 1610 is capable of functioning as a polarizing plate and/or a polarizing filter. In other words, the dummy wires 1615 may be arranged such that the E-plane control layer 1610 functions as a polarizing plate and/or a polarizing filter. In this case, the E-plane control layer 1610 is capable of passing only an electromagnetic wave polarized in a specific direction or capable of passing only a component electromagnetic wave polarized in a specific direction in the incident electromagnetic wave. The polarization direction of electromagnetic wave can be defined as the direction of the electric field of the electromagnetic wave. Accordingly, only the electromagnetic wave, of which the polarization direction is perpendicular to the wires of the E-plane control layer 1610, is allowed to pass through, or only the component electromagnetic wave, of which the polarization direction is perpendicular to the wires of the E-plane control layer 1610, in an incident electromagnetic wave is allowed to pass through the E-plane control layer 1610. Hereinafter, for convenience of explanation, a direction perpendicular to the wires of the E-plane control layer 1610 is defined as a y direction, and a direction horizontal to the wires of the E-plane control layer 1610 is defined as an x direction. In the disclosure, the x direction and the y direction mean relative directions for indicating directions perpendicular to each other, and do not mean absolute directions. For example, the direction perpendicular to the wires of the E-plane control layer 1610 may also be defined as the x direction, and the direction horizontal to the wires of the E-plane control layer 1610 may also be defined as the y direction. Further, in the disclosure, an electromagnetic wave polarized in the x direction may be referred to as an x-polarized electromagnetic wave, and an electromagnetic wave polarized in the y direction may be referred to as a y-polarized electromagnetic wave. Any electromagnetic wave may include a component electromagnetic wave polarized in the x direction and a component electromagnetic wave polarized in the y direction. Hereinafter, the component electromagnetic wave polarized in the X direction in the electromagnetic wave may be referred to as an x-polarized component of the electromagnetic wave, and the component electromagnetic wave polarized in the y direction may be referred to as a y-polarized component of the electromagnetic wave. According to the above-described examples, the dummy wires 1615 may be arranged in the E-plane control layer 1610 such that the E-plane control layer 1610 is capable of functioning as a polarizing plate and/or a polarizing filter. However, the dummy wires 1615 may be unnecessary when the interval between adjacent wires of the E-plane control wires 1613 is equal to or less than a predetermined interval so as to make the E-plane control layer 1610 function as a polarizing plate and/or a polarizing filter. In other words, the dummy wires 1615 in the E-plane control layer 1610 may be omitted.

The unit cell layer 1620 may include a plurality of unit cells, including a unit cell 1623. Hereinafter, the characteristics of the unit cell 1623 will be described for convenience of explanation, but the characteristics of the unit cell 1623 can be similarly applied to other unit cells of the unit cell layer 1620. The unit cell 1623 may include a variable capacitor region disposed in a direction shielded from an external electromagnetic wave. Accordingly, the unit cell 1623 may have a non-resonance characteristic, and the structure of the unit cell 1623 may be a structure that allows the unit cell 1623 to maintain electrical dipole characteristics as a whole. The variable capacitor region of the unit cell 1623 may include a dielectric (e.g., dielectric 503).

According to various embodiments of the disclosure, the unit cell 1623 may change the polarization direction of an electromagnetic wave incident on the unit cell 1623. In other words, an electromagnetic wave incident on the unit cell 1623 may be refracted by an angle set by the controller 230 with respect to the E-plane and/or the H-plane, and the polarization direction of the electromagnetic wave may be changed. For example, when electromagnetic wave having only a y-polarized component is incident on the unit cell 1623, the polarization direction of the electromagnetic wave is changed, and the electromagnetic wave passing through the unit cell 1623 may have both an x-polarized component and a y-polarized component. When the electromagnetic wave having only the x-polarized component is incident on the unit cell 1623, the polarization direction of the electromagnetic wave is changed, and the electromagnetic wave passing through the unit cell 1623 may have both the x-polarized component and the y-polarized component. According to various embodiments of the disclosure, changing the polarization direction of an incident electromagnetic wave may be referred to as "polarization conversion" and/or "polarization rotation" and the function of the unit cell 1623 may be referred to as a "polarization conversion function" and/or a "polarization rotation function". The structure of the unit cell 1623 for changing the polarization direction of an incident electromagnetic wave will be described in more detail with reference to FIGS. 18A to 18C.

The H-plane control layer 1630 may include H-plane control wires 1633 and dummy wires 1635. Here, the dummy wires 1635 are included in the H-plane control layer 1630, but unlike the H-plane control wires, the dummy wires 1635 may not be used to control the angle of the electromagnetic wave incident on the lens 250 with respect to the H-plane. In other words, the dummy wires 1635 are not electrically connected to the unit cells of the unit cell layer 1620 and may not be used to control the unit cells. Each of the dummy wires 1635 may be disposed between at least two H-plane control wires among the H-plane control wires 1633. In the H-plane control layer 1630, the wires may be arranged parallel to each other. Further, the wires of the H-plane control layer 1630 may be arranged perpendicular to the wires of the E-plane control layer 1610.

Similar to the dummy wires 1615, the dummy wires 1635 may be disposed such that the interval between adjacent wires in the H-plane control layer 1630 is equal to or less than a predetermined interval. Since the interval between adjacent wires in the H-plane control layer 1630 is equal to or less than the predetermined interval, the H-plane control layer 1630 is capable of functioning as a polarizing plate and/or a polarizing filter. In other words, the dummy wires 1635 may be arranged such that the H-plane control layer 1630 functions as a polarizing plate and/or a polarizing filter. In this case, the H-plane control layer 1630 is capable of passing only an electromagnetic wave polarized in a specific direction or capable of passing only a component electromagnetic wave polarized in a specific direction in the incident electromagnetic wave. Accordingly, only the electromagnetic wave, of which the polarization direction is perpendicular to the wires of the H-plane control layer 1630, is allowed to pass through, or only the component electromagnetic wave, of which the polarization direction is perpendicular to the wires of the H-plane control layer 1630, is allowed to pass through the H-plane control layer 1630. For example, when the control wires in the H-plane control layer 1630 are perpendicular to those of the E-plane control layer 1610, the H-plane control layer 1630 may pass only an x-polarized electromagnetic wave or may pass only an x-polarized component in the incident electromagnetic wave.

According to the above-described examples, the dummy wires 1630 may be arranged in the H-plane control layer 1630 such that the H-plane control layer 1630 is capable of functioning as a polarizing plate and/or a polarizing filter. However, the dummy wires 1635 may be unnecessary when the interval between adjacent wires of the H-plane control wires 1633 is equal to or less than a predetermined interval so as to make the H-plane control layer 1630 function as a polarizing plate and/or a polarizing filter. In other words, the dummy wires 1635 in the H-plane control layer 1630 may be omitted.

Hereinafter, descriptions will be made of phenomena occurring within and around a lens 250, which includes an E-plane control layer 1610 and an H-plane control layer 1630 functioning as a polarizing plate and/or a polarizing filter and a unit cell layer 1620 including a permittivity modulation element and unit cells having a polarization conversion function, when an electromagnetic wave passes through the lens 250.

According to FIG. 16, an electromagnetic wave 1641 polarized in the y direction is incident on the lens 250. The electromagnetic wave 1641 is first incident on the E-plane control layer 1610 of the lens 250. Since the polarization direction (i.e., the y direction) of the electromagnetic wave 1641 is perpendicular to the direction of the control wires of the E-plane control layer 1610, the electromagnetic wave 1641 can pass through the E-plane control layer 1610 without loss. On the other hand, when an x-polarized electromagnetic wave is incident on the E-plane control layer 1610, the incident electromagnetic wave may be reflected without passing through the E-plane control layer 1610. The electromagnetic wave 1641 passing through the E-plane control layer 1610 corresponds to an electromagnetic wave 1643. As another example, the electromagnetic wave 1641 may be an electromagnetic wave polarized in an arbitrary direction. In this case, the x-polarized component of the electromagnetic wave 1641 is reflected from the E-plane control layer 1610, the y-polarized component of the electromagnetic wave 1641 passes through the E-plane control layer 1610, and the y-polarized component of the electromagnetic wave 1641, which has passed through the E-plane control layer 1610, may correspond to the electromagnetic wave 1643.

The electromagnetic wave 1643 is incident on the unit cell layer 1620. As the electromagnetic wave 1643 passes through the unit cell layer 1620, the electromagnetic wave 1643 is refracted by an angle determined based on the permittivity of the unit cell controlled by the controller 230, and the polarization direction of the electromagnetic wave 1643 is converted. In the disclosure, an angle, for which a reference plane (e.g., an E-plane or an H-plane) is not specified, may include at least one of an angle with respect to the E-plane and an angle with respect to the H-plane. Accordingly, the electromagnetic wave 1643, which has passed through the E-plane control layer 1610, has only a y-polarized component. However, as the electromagnetic wave 1643 passes through the unit cell 1620 including the unit cells having a polarization conversion function, the electromagnetic wave 1643 may be divided into an electromagnetic wave 1645 having an x-polarized component and an electromagnetic wave 1647 having a y-polarized component. The electromagnetic wave 1645 and the electromagnetic wave 1647 are incident on the H-plane control layer 1630. Since the polarization direction (i.e., the x direction) of the electromagnetic wave 1645 is perpendicular to the direction of the control wires of the H-plane control layer 1630, the electromagnetic wave 1645 can pass through the H-plane control layer 1630 without loss. On the other hand, the electromagnetic wave 1647 polarized in the y direction may be reflected without passing through the H-plane control layer 1630. The reflected electromagnetic wave 1647 is incident on the unit cell layer 1620 again. As the electromagnetic wave 1647 passes through the unit cell layer 1620, the electromagnetic wave 1647 is refracted by an angle determined based on the permittivity of the unit cell controlled by the controller 230, and the polarization direction of the electromagnetic wave 1647 is converted. In other words, the electromagnetic wave 1647 may be divided into an electromagnetic wave 1649 having a y-polarized component and an electromagnetic wave 1651 having an x-polarized component by passing through the unit cell layer 1620. The electromagnetic wave 1649 and the electromagnetic wave 1651 are incident on the E-plane control layer 1610. In this case, the electromagnetic wave 1649 having the y-polarized component passes through the E-plane control layer 1610, and the electromagnetic wave 1651 having the x-polarized component may be reflected without passing through the E-plane control layer 1610. The reflected electromagnetic wave 1651 is incident on the unit cell layer 1620 again. As the electromagnetic wave 1651 passes through the unit cell layer 1620, the electromagnetic wave 1651 is refracted by an angle determined based on the permittivity of the unit cell controlled by the controller 230, and the polarization direction of the electromagnetic wave 1651 is converted. In other words, the electromagnetic wave 1651 may be divided into an electromagnetic wave 1653 having an x-polarized component and an electromagnetic wave 1655 having a y-polarized component by passing through the unit cell layer 1620. The electromagnetic wave 1653 and the electromagnetic wave 1655 are incident on the H-plane control layer 1630. In this case, the electromagnetic wave 1653 having the x-polarized component passes through the H-plane control layer 1630, and the electromagnetic wave 1655 having the y-polarized component may be reflected without passing through the H-plane control layer 1630. The reflected electromagnetic wave 1655 is incident on the unit cell 1620 again, and the above-described processes can be repeated.

The electromagnetic wave 1657 is an x-polarized electromagnetic wave which finally passes through the H-plane control layer 1630 and the lens 250. Thus, as a whole, the electromagnetic wave 1641 is incident on the lens 250, and the electromagnetic wave 1657 is emitted from the lens. An electromagnetic wave experiences several times the reflection by the E-plane control layer 1610 and the H-plane control layer 1630 and the refraction and polarization conversion by the unit cell layer 1620 while the electromagnetic wave passes through the lens 250. The refraction angle is accumulated whenever the electromagnetic wave passes through the unit cell 1620, and thus the electromagnetic wave 1657 finally emitted from the lens 250 may be refracted by the accumulated angle relative to the electromagnetic wave 1641 incident on the lens 250.

In order to cause an electromagnetic wave incident on the lens 250 at an arbitrary angle to be refracted at an arbitrary angle, the phase characteristic of the lens 250 is required to be 180 degrees. According to various embodiments of the disclosure, the phase characteristic of the lens means an angular range in which the lens can refract the angle of an electromagnetic wave incident on the lens. Since the refraction angle of an electromagnetic wave incident on the lens is accumulated whenever the electromagnetic wave passes through the unit cell layer of the lens, the phase characteristic of the lens can be proportional to the number of times the electromagnetic wave passes through the unit cell layer. According to various embodiments of the disclosure, an electromagnetic wave incident on the lens 250 can pass through the unit cell layer 1620 multiple times due to the reflection by the E-plane control layer 1610 and/or the H-plane control layer 1630 and the polarization by the unit cell layer 1620, and the refraction angles of the electromagnetic wave can be accumulated. Therefore, the phase characteristics of the lens 250 can be sufficiently ensured even if the angular range of refraction by the unit cell layer 1620 is limited.

FIG. 16 illustrates that respective layers are arrangement such that an incident electromagnetic wave passes through the E-plan control layer 1610, the unit cell layer 1620, and the H-plane control layer 1630 in this order. However, this is an example, and the order of arrangement of respective layers may be changed. For example, respective layers of the lens 250 may be arranged such that an incident electromagnetic wave passes through the H-plane control layer 1630, the unit cell layer 1620 and the E-plane control layer 1610 in this order. In this case, the final electromagnetic wave passing through the lens 250 may be a y-polarized electromagnetic wave.

Figure 17:
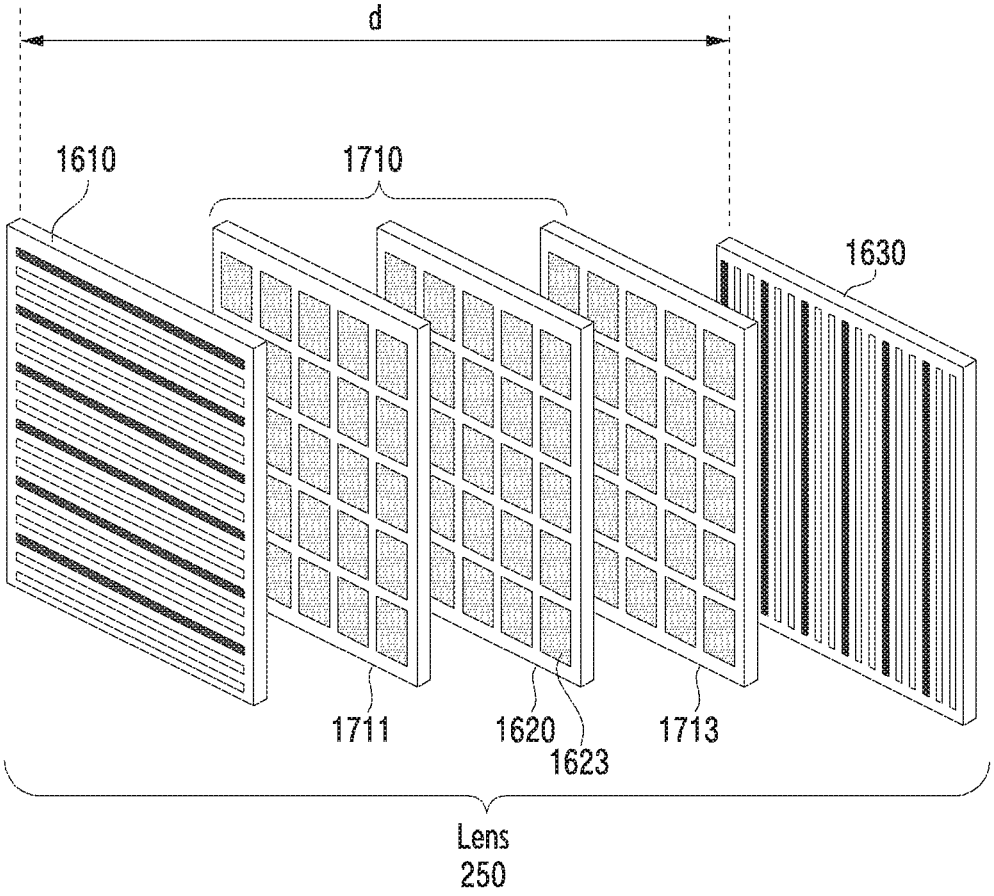
FIG. 17 illustrates layers of a lens according to an embodiment of the disclosure.

FIG. 17 illustrates layers of a lens according to various embodiments of the disclosure.

Referring to FIG. 17, the lens 250 may include an E-plane control layer 1610, unit cell layers 1710, and an H-plane control layer 1630. The unit cell layers 1710 may include a unit cell layer 1711 and a unit cell layer 1713, in addition to the unit cell layer 1620. The unit cell layer 1620 may include a plurality of unit cells including a unit cell 1623, and the unit cell layer 1711 and the unit cell layer 1713 may also include a plurality of unit cell layers. The unit cells included in each of the unit cell layers 1710, 1620, and 1730 may perform the same function as the unit cell 1623. According to various embodiments of the disclosure, each of the E-plane control layer 1610 and the H-plane control layer 1630 may function as a polarizing plate and/or a polarizing filter. The distance between the E-plane control layer 1610 and the H-plane control layer 1630 (i.e., the distance between the polarizing plates) may be defined as d.

In order to ensure that the phase characteristic of the lens 250 becomes 180 degrees according to the continuous reflection and/or polarization conversion of the electromagnetic wave by the E-plane control layer 1610 and the H-plane control layer 1630 between the E-plane control layer 1610 and the H-plane control layer 1630, the distance d needs to be ½ times or integer times of the wavelength of the electromagnetic wave incident on the lens 250. That is, the thickness of the lens may be limited in order to achieve the phase characteristic of 180 degrees, and the thickness of the lens may not be small enough to be integrated according to this limitation. Thus, according to various embodiments of the disclosure, since a plurality of unit cell layers 1710 are disposed between the E-plane control layer 1610 and the H-plane control layer 1630, physical distance (i.e., d) between the E-plane control layer 1610 and the H-plane control layer 1630 can be reduced while the electrical equivalent distance between the E-plane control layer 1610 and the H-plane control layer 1630 becomes ½ times or integer times of the wavelength of an incident electromagnetic wave. That is, according to various embodiments of the disclosure, since a plurality of unit cell layers 1710 are disposed between the E-plane control layer 1610 and the H-plane control layer 1630, complete physical integration of polarizing filters (e.g., the E-plane control layer 1610 and H-plane control layer 1630) and the unit cell layer(s) can be realized. In this case, the control for individual unit cells of the unit cell layers 1710 may be performed by the control wires of the E-plane control layer 1610 and/or the control wires of the H-plane control layer 1630. In other words, the plurality of unit cell layers 1710 can be controlled at once by respective single E-plane control layer 1610 and H-plane control layer 1630.

FIG. 17 illustrates that lens 250 includes three unit cell layers 1710, 1620, and 1730. However, this is exemplary, and the number of unit cell layers included in the lens 250 is not limited thereto. In other words, the lens 250 may include unit cell layers, the number of which is determined to ensure that the electrical equivalent distance between the E-plane control layer 1610 and the H-phase control layer 1630 for the phase characteristic of the lens 250 to be 180 degrees is ½ times or integer times of the wavelength of an incident electromagnetic wave.

Figure 18A:
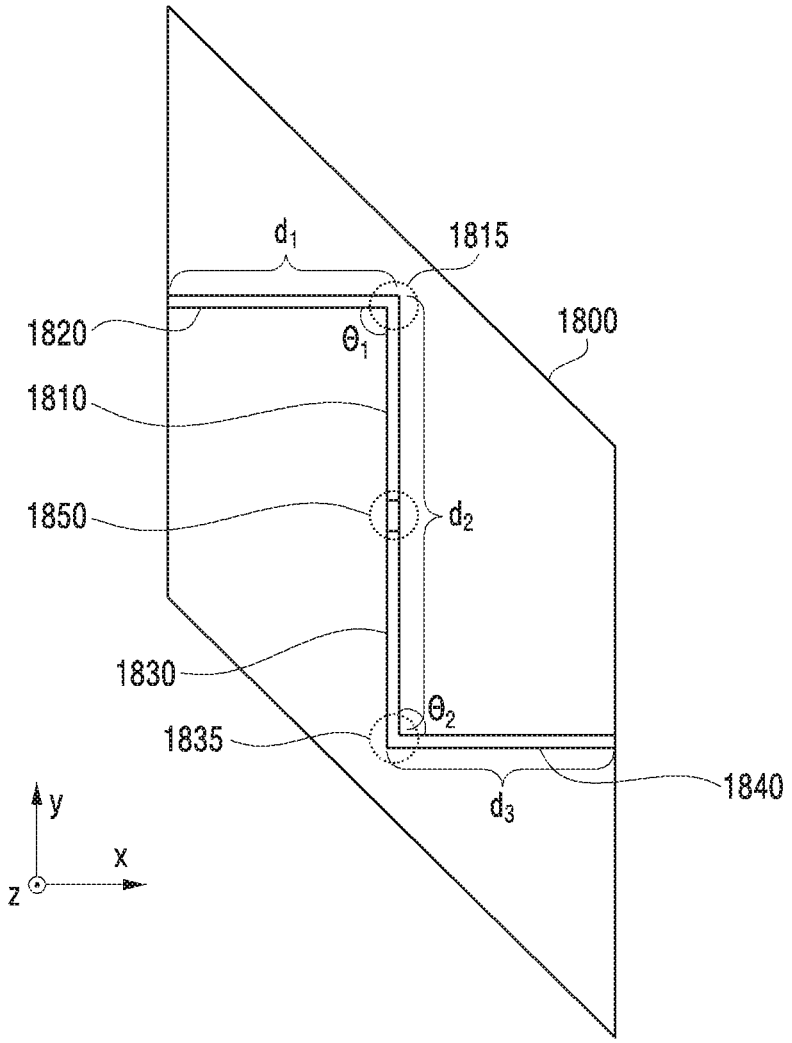
FIGS. 18A, 18B, and 18C illustrate a unit cell structure for polarization conversion according to various embodiments of the disclosure.
Figure 18B:
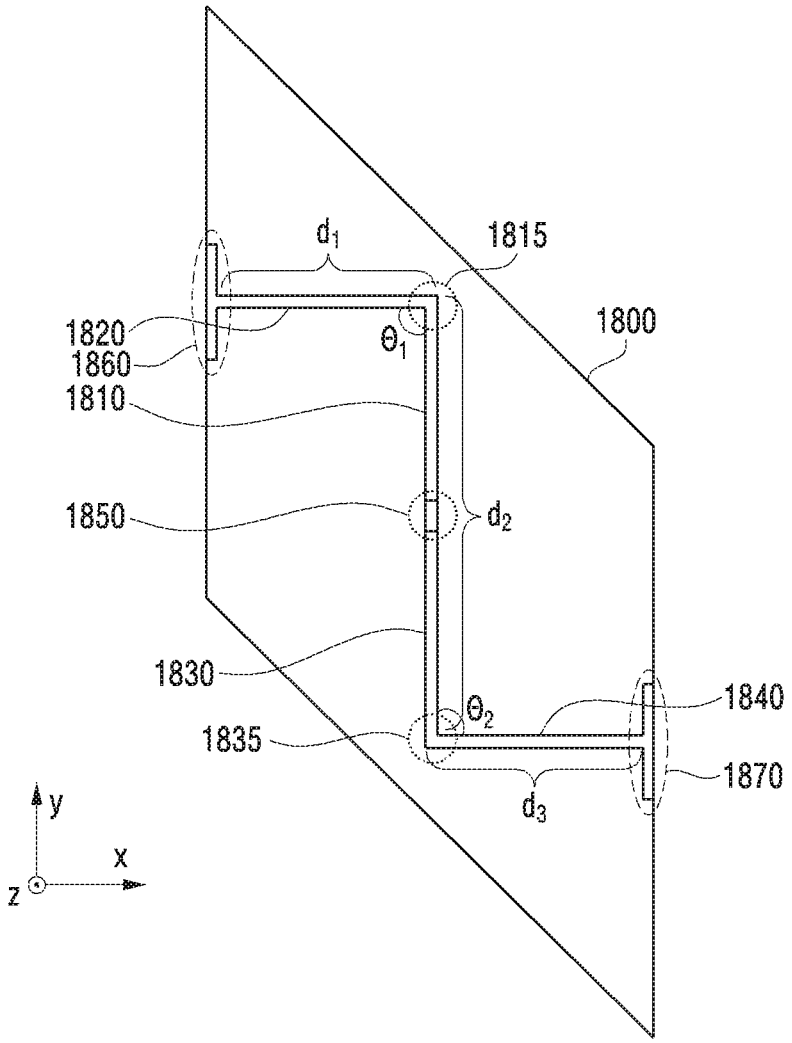
Figure 18C:
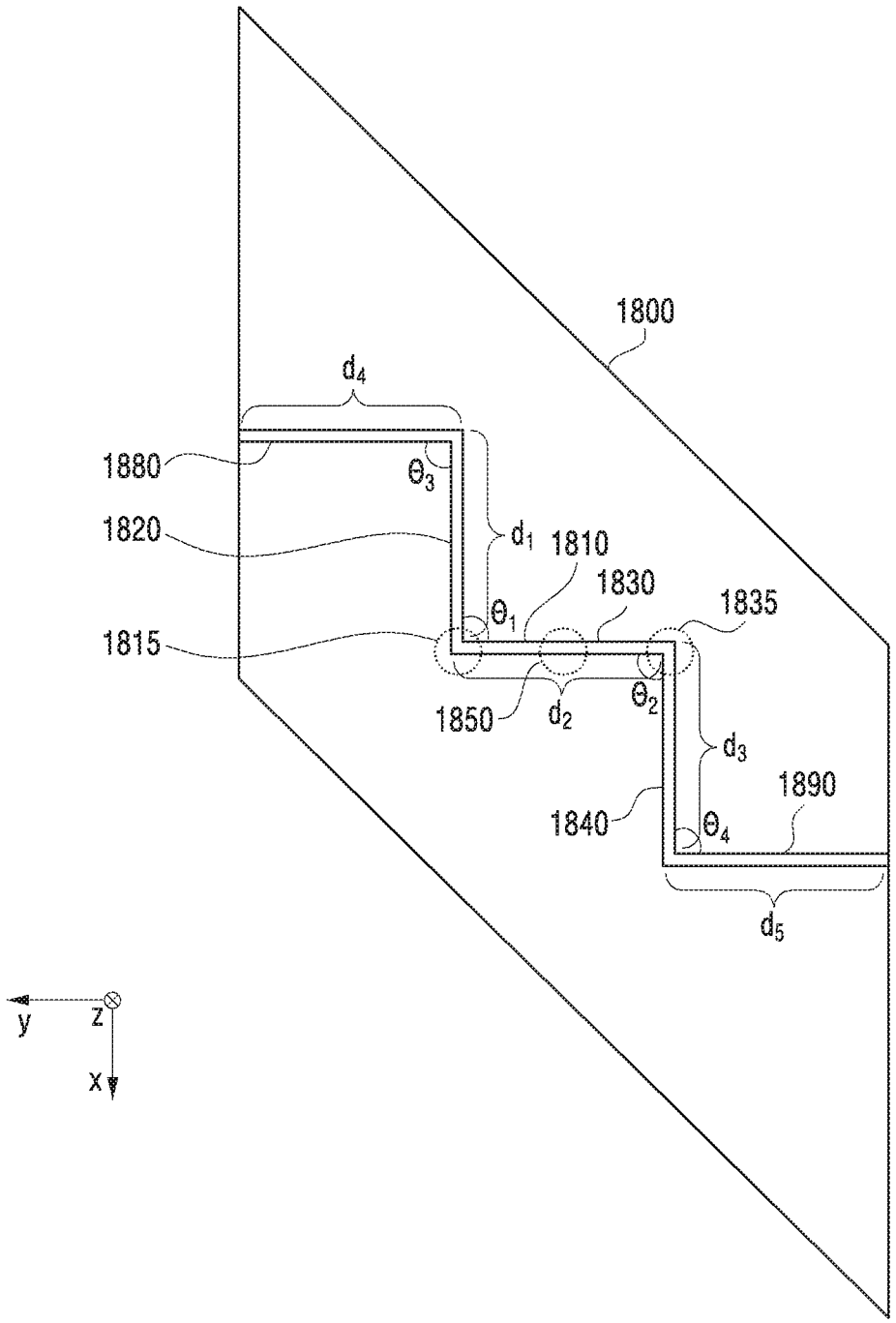

FIGS. 18A to 18C illustrate a unit cell structure for polarization conversion according to various embodiments of the disclosure. The unit cell 1800 of FIGS. 18A to 18C may be a unit cell included in the unit cell layer 1620 of FIG. 16 (e.g., the unit cell 1623).

Referring to FIG. 18A, the unit cell 1800 may include a first conductive member 1810, a second conductive member 1830 disposed in a manner of overlapping at least a portion of the first conductive member 1810 and spaced apart from the first conductive member 1810, and a dielectric interposed between the overlapped portions of the first conductive member 1810 and the second conductive member 1830. The overlap region of the first conductive member 1810 and the second conductive member 1830 (i.e., a variable capacitor region 1850) may be disposed in a direction shielded from an external electromagnetic wave.

In addition, the unit cell 1800 may further include a third conductive member 1820 extending from the first conductive member 1810 and bent at a determined first angle $\theta_1$ from the first conductive member 1810, and a fourth conductive member 1840 extending from the second conductive member 1830 and bent at a predetermined second angle $\theta_2$. The bent portion between the first conductive member 1810 and the third conductive member 1820 may be referred to as a bent portion 1815 and the bent portion between the second conductive member 1830 and the fourth conductive member 1840 may be referred to as a bent portion 1835. The third conductive member 1820 and the fourth conductive member 1840 may be bent in opposite directions, and the first angle $\theta_1$ and the second angle $\theta_2$ may be equal to each other. FIG. 18A illustrates that the first angle $\theta_1$ and the second angle $\theta_2$ are 90 degrees. However, this is exemplary, and the first angle $\theta_1$ and the second angle $\theta_2$ may have various angles.

When an electromagnetic wave is incident on the unit cell 1800 in the −z direction, current in the x direction may flow in the third conductive member 1820 and the fourth conductive member 1840 by the incident electromagnetic wave, and current in the y direction may flow in the first conductive member 1810 and the second conductive member 1830. That is, both the current in the x direction and the current in the y direction may flow regardless of the polarization direction of the electromagnetic wave incident from the conductive members of the unit cell 1800. The electromagnetic wave, which has passed through the unit cell 1800, may have an x-polarized component by the current in the x direction, and the electromagnetic wave, which has passed through the unit cell 1800, may have a y-polarized component by the current in the y direction. In other words, regardless of the polarization direction of the electromagnetic wave incident on the unit cell 1800, the electromagnetic wave, which has passed through the unit cell 1800 according to the structure of the unit cell 1800, may have both the x-polarized component and the y-polarized component, and polarization conversion may be performed on the incident electromagnetic wave. Here, the magnitude of the x-polarized component of the electromagnetic wave, which has passed through the unit cell 1800, may be proportional to the sum ($d_1+d_2$) of the lengths of the third conductive member 1820 and the fourth conductive member 1840 in which the current in the x direction flows. In other words, the magnitude of the x-polarized component of the electromagnetic wave, which has passed through the unit cell 1800, may increase as $d_1+d_2$ increases. Similarly, the magnitude of the y-polarized component of the electromagnetic wave, which has passed through the unit cell 1800, may be proportional to the sum ($d_2$) of the lengths of the first conductive member 1810 and the second conductive member 1830 in which the current in the y direction flows. In other words, the magnitude of the y-polarized component of the electromagnetic wave, which has passed through the unit cell 1800, may increase as $d_2$ increases.

Various modifications are possible for the unit cell 1800 of FIG. 18A.

Referring to FIG. 18B, the unit cell 1800 may include a fifth conductive member 1860 extending from the third conductive member 1820 and composed of conductive member portions bent in opposite directions from the third conductive member 1820, and a sixth conductive member 1870 extending from the fourth conductive member 1840 and composed of conductive member portions bent in opposite directions from the fourth conductive member 1840.

Referring to FIG. 18C, the unit cell 1800 may further include a seventh conductive member 1880 extending from the third conductive member 1820 and bent at a determined first angle $\theta_3$ from the third conductive member 1820, and an eighth conductive member 1890 extending from the fourth conductive member 1840 and bent at a predetermined fourth angle $\theta_4$ from the fourth conductive member 1840. The seventh conductive member 1880 and the eighth conductive member 1890 may be bent in opposite directions, and the third angle $\theta_3$ and the fourth angle $\theta_4$ may be equal to each other. FIG. 18C illustrates that the third angle $\theta_3$ and the fourth angle $\theta_4$ are 90 degrees. However, this is exemplary, and the third angle $\theta_3$ and the fourth angle $\theta_4$ may have various angle values. The electromagnetic wave, which has passed through the unit cell 1800, may have a y-polarized component by the current flowing in the seventh conductive member 1880, the first conductive member 1810, the second conductive member 1830, and the eighth conductive member 1890 regardless of the polarization direction of the electromagnetic wave incident on the unit cell 1800, and may have an x-polarized component by the current flowing in the third in the third conductive member 1820 and the fourth conductive member 1840. In FIG. 18C, the magnitude of the x-polarized component of the electromagnetic wave, which has passed through the unit cell 1800, may be proportional to the sum ($d_1+d_2$) of the lengths of the third conductive member 1820 and the fourth conductive member 1840 in which the current in the x direction flows, and the magnitude of the y-polarized component of the electromagnetic wave may be proportional to the sum ($d_4+d_2+d_5$) of the lengths of the seventh conductive member 1880, the first conductive member 1810, the second conductive member 1830, and the eighth conductive member 1890 in which the current in the y direction flows.

The structures of the unit cell 1800 illustrated in FIGS. 18A to 18C are examples, and various modifications are possible. For example, as illustrated in FIG. 5B, the second conductive member 1830 may overlap another portion of the first conductive member 1810, and a dielectric may be interposed between the overlapped portions so as to form another variable capacitor region. As another example, as in FIGS. 6D and 6E, the unit cell 1800 may further include at least one other conductive member and at least a portion of the at least one other conductive member and the first conductive member 1810 and/or the second conductive member 1830 may overlap each other so as to form a variable capacitor region (including a dielectric interposed between the overlapped portions). In addition, variable element conductors in the variable capacitor region 1850 may be shaped as illustrated in FIG. 6B, and the end portions (corresponding to the head portion or tail portion) of the third conductive member 1820 and the fourth conductive member 1840, which are not connected to the bent portions 1815 and 1835, may be shaped as illustrated in FIG. 6A.

Figure 19A:
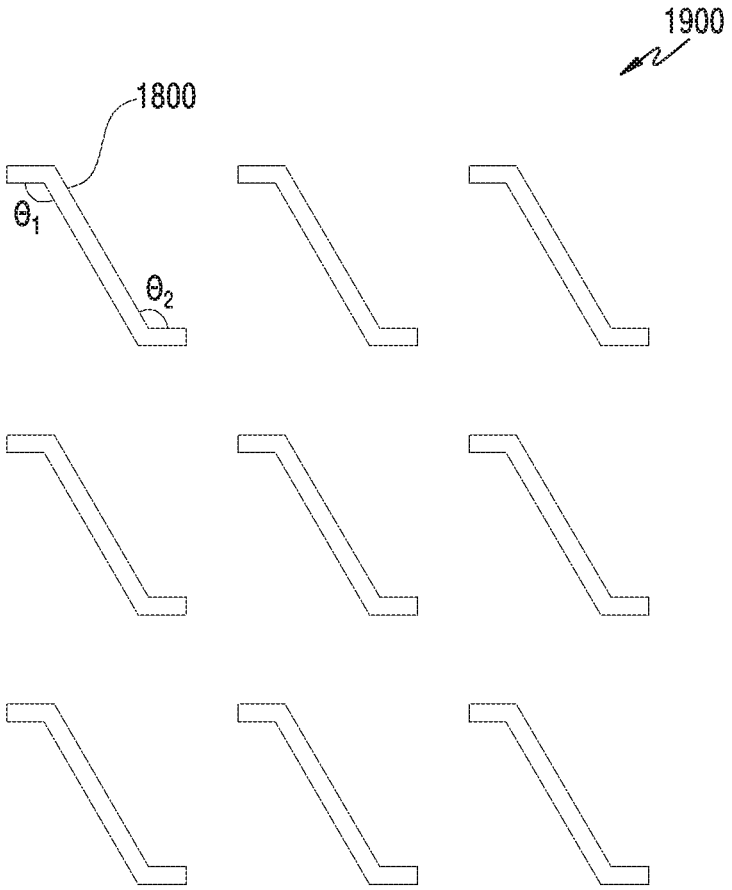
FIGS. 19A and 19B illustrate unit cells for polarization conversion in a unit cell layer according to various embodiments of the disclosure.
Figure 19B:
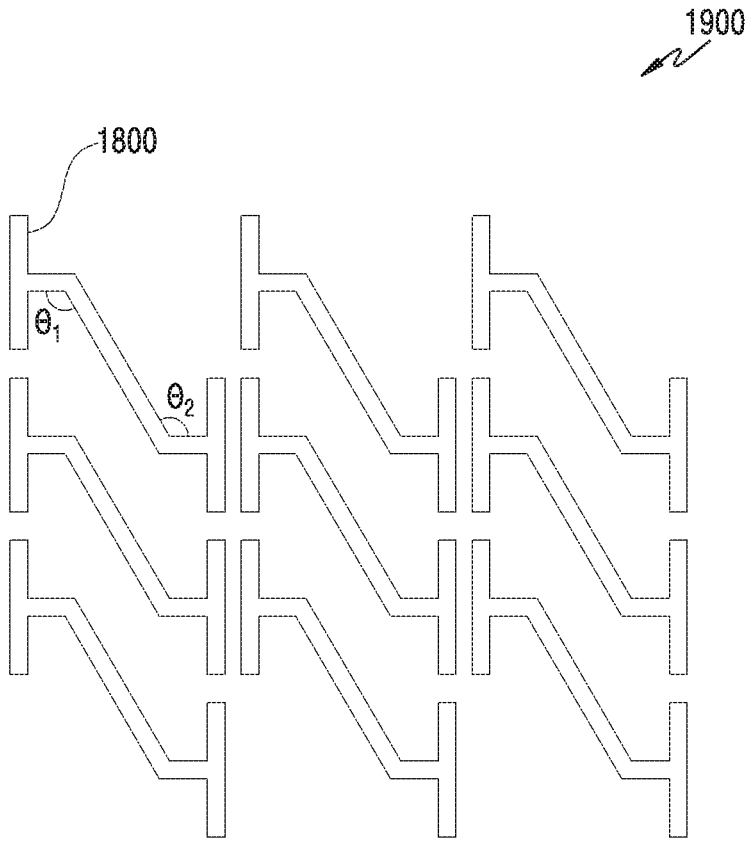

FIGS. 19A and 19B illustrate unit cells for polarization conversion in a unit cell layer 1900 according to various embodiments of the disclosure.

Referring to FIG. 19A, the unit cell layer 1900 may include a plurality of unit cells each having the same unit cell structure as the unit cell 1800 of FIG. 18A. In FIG. 19A, the first angle $\theta_1$ and the second angle $\theta_2$ may be equal to each other, and may be larger than 90 degrees (e.g., 135 degrees).

Referring to FIG. 19B, the unit cell layer 1900 may include a plurality of unit cells each having the same unit cell structure as the unit cell 1800 of FIG. 18B. In FIG. 19B, the first angle $\theta_1$ and the second angle $\theta_2$ may be equal to each other, and may be larger than 90 degrees (e.g., 135 degrees).

As in FIGS. 19A and 19B, even if the first angle $\theta_1$ and the second angle $\theta_2$ are not 90 degrees, all currents flowing in any direction in the conductive members of the unit cell 1800 may be expressed by the sum of a current component in the x direction and a current component in the y direction. Thus, the electromagnetic wave, which has passed through the unit cell layer 1900, may have both of an x-polarized component and a y-polarized component by these component currents.

Figure 20:
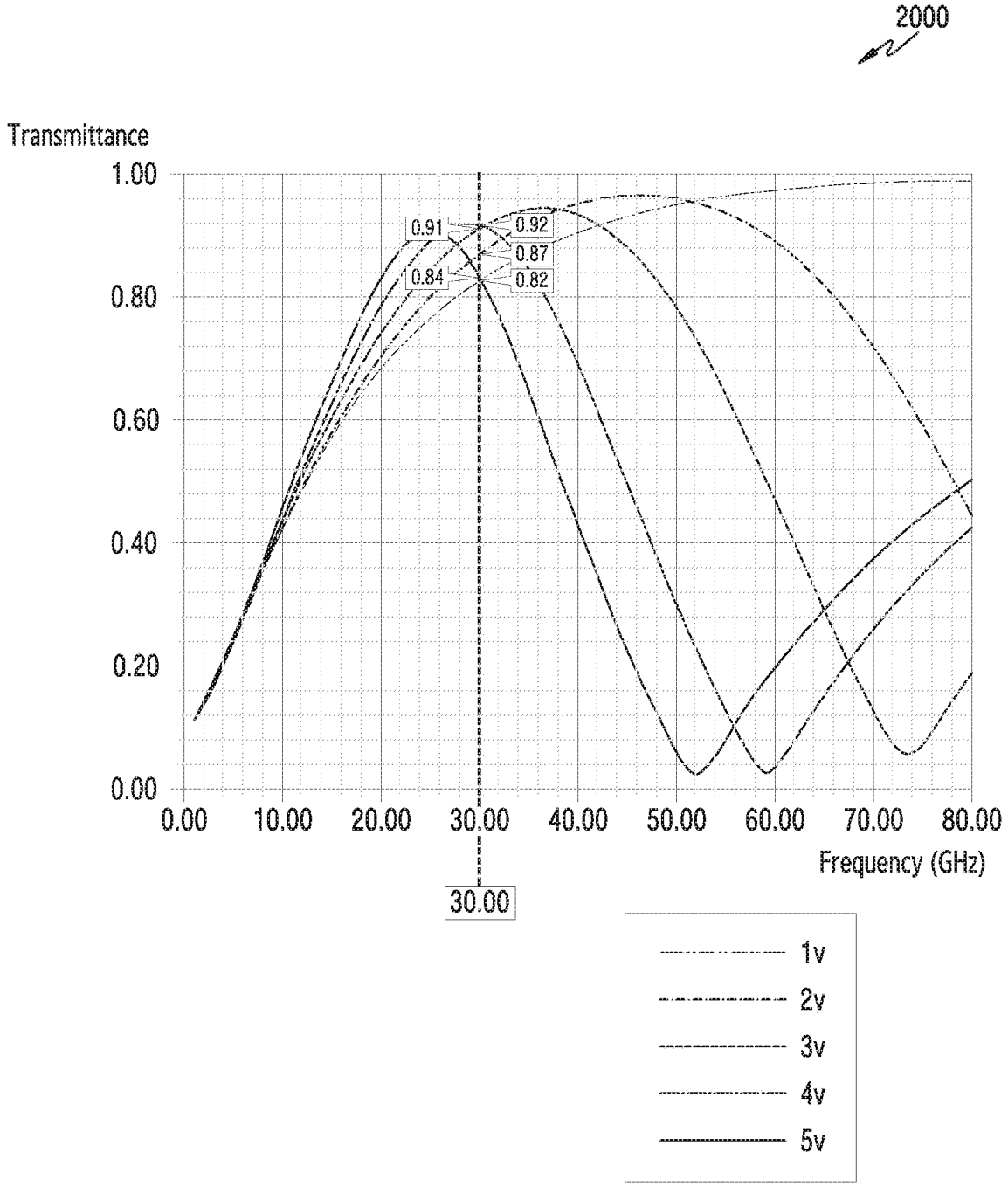
FIG. 20 is a graph illustrating a relationship between the frequency of electromagnetic wave passing through a unit cell layer and the transmittance of the unit cell layer for each voltage applied to the unit cells of a unit cell layer according to an embodiment of the disclosure.

FIG. 20 is a graph 2000 illustrating a relationship between the frequency of electromagnetic wave passing through a unit cell layer and the transmittance of the unit cell layer for each voltage applied to the unit cells of a unit cell layer according to an embodiment of the disclosure.

Figure 21:
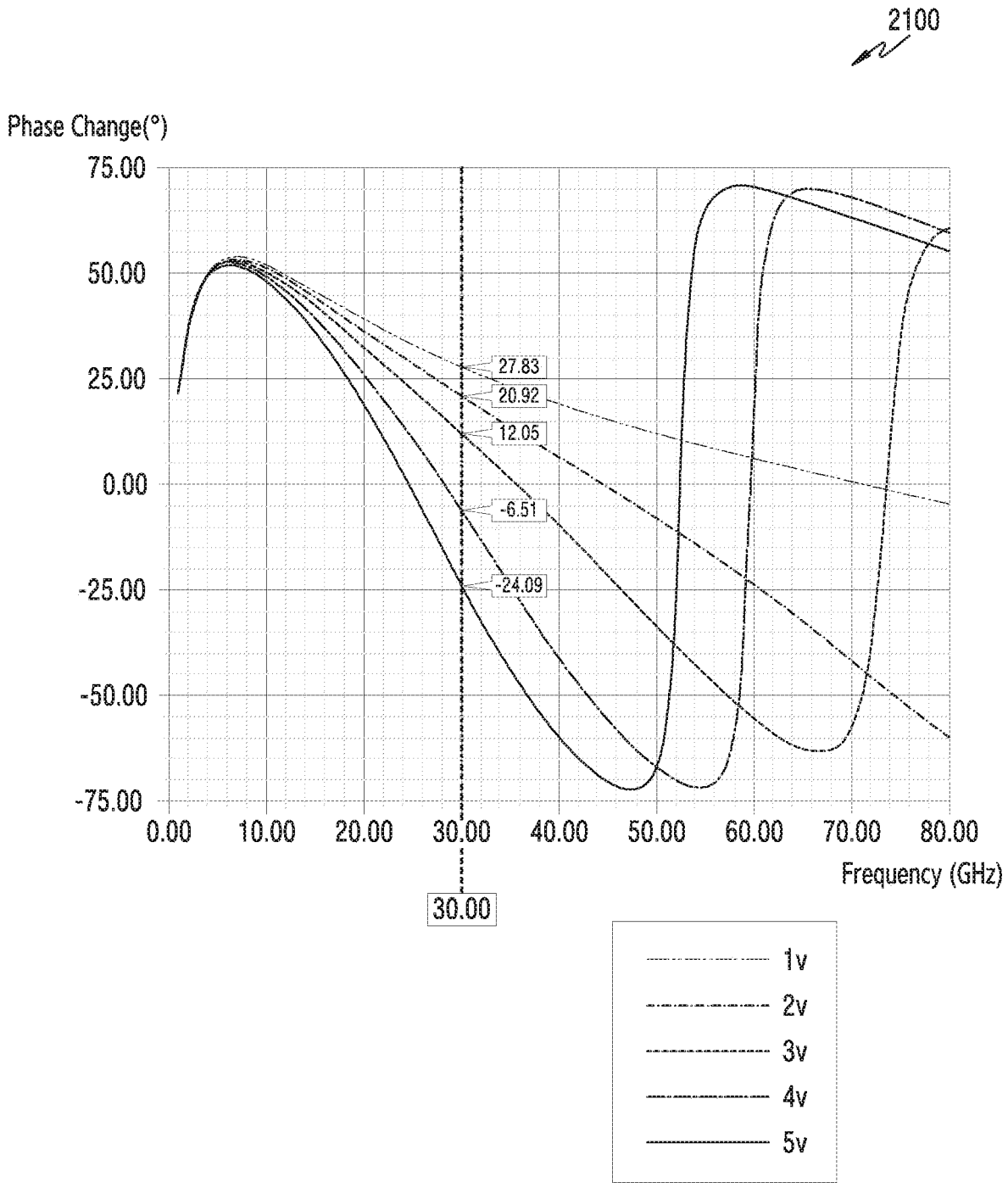
FIG. 21 is a graph illustrating a relationship between the frequency of electromagnetic wave passing through a unit cell layer and the phase change of the electromagnetic wave for each voltage applied to the unit cells of a unit cell layer according to an embodiment of the disclosure.

FIG. 21 is a graph 2100 illustrating a relationship between the frequency of electromagnetic wave passing through a unit cell layer and the phase change of the electromagnetic wave for each voltage applied to the unit cells of a unit cell layer according to an embodiment of the disclosure. For the graph 2000 and the graph 2100, the following conditions are assumed:

(1) Unit cells of a unit cell layer are arranged on a board (mother board) having a permittivity of 3.5 F/m and a thickness of 25 μm;

(2) Each unit cell has a size of 500 μm×800 μm (e.g., each unit cell has the same structure as the unit cell 501 or the unit cell 502 illustrated in FIGS. 5A and/or 5B and has a vertical length α of 500 μm and a horizontal length β of 800 μm), and the conductive members included in each unit cell are made of aluminum (Al); and (3) An Electromagnetic wave passes through a single unit cell layer and are not reflected or polarized by control wires (e.g., E-plane control wires and/or H-plane control wires) or a control wire layer. The control wires are aluminum metal wires.

In the graph 2000, the horizontal axis indicates the frequency (unit: GHz) of an electromagnetic wave passing through a unit cell, and the vertical axis indicates the transmittance of the unit cell. Referring to the graph 2000, when the voltage applied to the unit cells is 1 V and the frequency of the electromagnetic wave passing through the unit cell layer is 30 GHz, the transmittance of the unit cell layer is 0.82 (i.e., 82%). When the voltage applied to the unit cells is 2 V and the frequency of the electromagnetic wave passing through the unit cell layer is 30 GHz, the transmittance of the unit cell layer is 0.87 (i.e., 87%). When the voltage applied to the unit cells is 3 V and the frequency of the electromagnetic wave passing through the unit cell layer is 30 GHz, the transmittance of the unit cell layer is 0.91 (i.e., 91%). When the voltage applied to the unit cells is 4 V and the frequency of the electromagnetic wave passing through the unit cell layer is 30 GHz, the transmittance of the unit cell layer is 0.92 (i.e., 92%). When the voltage applied to the unit cells is 5 V and the frequency of the electromagnetic wave passing through the unit cell layer is 30 GHz, the transmittance of the unit cell layer is 0.84 (i.e., 84%). In other words, a unit cell layer including unit cells having a unit cell structure according to various embodiments of the disclosure has a high transmittance of 80% or more at 30 GHz as the voltage applied to the unit cell layer varies in the range of 1 V to 5 V, the energy reduction ratio of an electromagnetic wave passing through the unit cell layer may be less than 40% (=0.20×0.20×100).

In the graph 2100, the horizontal axis indicates the frequency (unit: GHz) of an electromagnetic wave passing through a unit cell, and the vertical axis indicates the phase change (unit: degree) of the electromagnetic wave due to the passage of the electromagnetic wave through the unit cell layer. Referring to the graph 2100, when the voltage applied to the unit cells is 1 V and the frequency of the electromagnetic wave passing through the unit cell layer is 30 GHz, the phase change of the electromagnetic wave is +27.83 degrees. When the voltage applied to the unit cells is 2 V and the frequency of the electromagnetic wave passing through the unit cell layer is 30 GHz, the phase change of the electromagnetic wave is +20.92 degrees. When the voltage applied to the unit cells is 3 V and the frequency of the electromagnetic wave passing through the unit cell layer is 30 GHz, the phase change of the electromagnetic wave is +12.05 degrees. When the voltage applied to the unit cells is 4 V and the frequency of the electromagnetic wave passing through the unit cell layer is 30 GHz, the phase change of the electromagnetic wave is −6.51 degrees. When the voltage applied to the unit cells is 5 V and the frequency of the electromagnetic wave passing through the unit cell layer is 30 GHz, the phase change of the electromagnetic wave is −20.92 degrees. In other words, when the above-mentioned conditions are satisfied, as the voltage applied to the unit cell layer changes within the range of 1 V to 5 V, the maximum range of the phase change at 30 GHz may be 27.83−(−24.09) =51.92 (degrees).

The above-described conditions are exemplary, and various embodiments of the disclosure are applicable even when at least one of the above conditions is changed. In other words, even if at least one of the above conditions is changed, the results shown in the graph 2000 and/or the graph 2100 may be derived, or results different from those shown in the graph 2000 and/or the graph 2100 may be derived. For example, when the size of a unit cell is larger than 500 μm×800 μm, the unit cell layer may have a high transmittance of 80% or more at a frequency (e.g., 10 GHz) lower than 30 GHz as the voltage applied to the unit cell layer changes within the range of 1 V to 5 V. As another example, when a plurality of unit cell layers are stacked as illustrated in FIG. 17 and thus an electromagnetic wave passes through the plurality of unit cell layers, and/or the electromagnetic wave is polarization-converted by the control wires or control wire layer, the maximum range of phase change at 30 GHz may be greater than 51.92 degrees as the voltage applied to the layer varies within the range of 1 V to 5 V.

Methods according to embodiments stated in claims and/or specifications of the disclosure may be implemented in hardware, software, or a combination of hardware and software.

When the methods are implemented by software, a computer-readable storage medium for storing one or more programs (software modules) may be provided. The one or more programs stored in the computer-readable storage medium may be configured for execution by one or more processors within the electronic device. The at least one program may include instructions that cause the electronic device to perform the methods according to various embodiments of the disclosure as defined by the appended claims and/or disclosed herein.

The programs (software modules or software) may be stored in nonvolatile memories including a random access memory and a flash memory, a read only memory (ROM), an electrically erasable programmable ROM (EEPROM), a magnetic disc storage device, a compact disc-ROM (CD-ROM), digital versatile discs (DVDs), or other type optical storage devices, or a magnetic cassette. Alternatively, any combination of some or all of the may form a memory in which the program is stored. Further, a plurality of such memories may be included in the electronic device.

In addition, the programs may be stored in an attachable storage device which is accessible through communication networks such as the Internet, Intranet, local area network (LAN), wide area network (WAN), and storage area network (SAN), or a combination thereof. Such a storage device may access the electronic device via an external port. Further, a separate storage device on the communication network may access a portable electronic device.

In the above-described detailed embodiments of the disclosure, a component included in the disclosure is expressed in the singular or the plural according to a presented detailed embodiment. However, the singular form or plural form is selected for convenience of description suitable for the presented situation, and various embodiments of the disclosure are not limited to a single element or multiple elements thereof. Further, either multiple elements expressed in the description may be configured into a single element or a single element in the description may be configured into multiple elements.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A communication device for controlling a beam in a wireless communication system, the communication device comprising:

a lens including:

at least one layer in which a plurality of unit cells are disposed;

at least one processor configured to:

determine a beam pattern, and control capacitance of each of the plurality of unit cells based on the beam pattern; and a transceiver configured to transmit a signal in the determined beam pattern through the lens, the lens being capacitance-controlled, wherein each of the plurality of unit cells includes:

a first conductive member, a second conductive member disposed by overlapping at least a portion of the first conductive member, and spaced apart from the first conductive member, and a dielectric interposed between overlapped portions of the first conductive member and the second conductive member, wherein a region of the first conductive member and a region of the second conductive member are overlapped in respect to a direction in which an external electromagnetic wave enters to the first conductive member and the second conductive member, and wherein the at least one layer includes:

a first layer configured to control an angle of the signal with respect to an E-plane, and a second layer configured to control an angle of the signal with respect to an H-plane.

2. The communication device of claim 1, wherein the dielectric includes at least one of a semiconductor device, a liquid crystal material, or a photoelectric material.

3. The communication device of claim 1, wherein the first conductive member and the second conductive member are symmetrical or asymmetrical with respect to the dielectric.

4. The communication device of claim 3, wherein each of the plurality of unit cells has a shape for having a non-resonance characteristic.

5. The communication device of claim 4, wherein each of the plurality of unit cells has an I-shape or an overturned H-shape.

6. The communication device of claim 4, wherein each of the plurality of unit cells has a dipole characteristic as a whole.

7. The communication device of claim 1, wherein the first conductive member and the second conductive member are electrically or physically disconnected.

8. The communication device of claim 1, wherein the lens comprises a plurality of control wires configured to control the unit cells of the first layer, and wherein each of the plurality of control wires is disposed along an equipotential plane for an electromagnetic wave corresponding to the signal.

9. The communication device of claim 1, wherein the lens includes a plurality of control wires configured to control the unit cells of the second layer, and wherein at least two control wires among the plurality of control wires overlap each other such that the at least two control wires respectively control different unit cell groups of the unit cells of the second layer.

10. The communication device of claim 1, wherein the lens includes a plurality of control wires configured to control the unit cells of the first layer, and wherein a plurality of control wires configured to control the unit cells of the second layer is arranged in directions perpendicular to each other.

11. The communication device of claim 1, wherein the lens includes a plurality of control wires configured to control the unit cells of the first layer, and wherein a plurality of control wires configured to control the unit cells of the second layer are arranged in different directions.

12. The communication device of claim 1, wherein the lens includes a plurality of control wires configured to control the unit cells of the first layer, and wherein the plurality of control wires are configured to control the unit cells of the second layer.

13. The communication device of claim 1, wherein the at least one processor is further configured to:

determine an E-plane control angle and an H-plane control angle corresponding to the beam pattern;

determine a first control voltage to be applied to the unit cells of the first layer based on the E-plane control angle;

determine a second control voltage to be applied to the unit cells of the second layer based on the H-plane control angle; and control the capacitance based on the first voltage and the second voltage, wherein the first control voltage and the second control voltage are expressed by an equation below:

$$V_H = \frac{2\pi x_H}{\lambda}\sin\theta_H$$

$$V_E = \frac{2\pi x_E}{\lambda}\sin\theta_E,$$

and wherein $\lambda$ represents a wavelength of the electromagnetic wave, $x_H$ represents a position of at least one unit cell, among the plurality of unit cells, to be controlled in the second layer with respect to the H-plane, $\theta_H$ represents the H-plane control angle, $V_H$ represents the second control voltage, $x_H$ represents a position of at least one unit cell, among the plurality of unit cells, to be controlled in the first layer with respect to the E-plane, $\theta_E$ represents the E-plane control angle, and $V_E$ represents the first control voltage.

14. The communication device of claim 1, wherein each of the plurality of unit cells includes:

a third conductive member extending from the first conductive member and bent at a first predetermined angle from the first conductive member; and a fourth conductive member extending from the second conductive member and bent at a second predetermined angle from the second conductive member.

15. The communication device of claim 14, wherein the third conductive member and the fourth conductive member are bent in opposite directions.

16. The communication device of claim 14, wherein the first angle and the second angle are equal to each other.

17. The communication device of claim 1, wherein an interval between adjacent control wires in the first layer or the second layer is set to be equal to or less than a predetermined interval such that the first layer or the second layer functions as a polarizing plate.

18. The communication device of claim 17, wherein the first layer or the second layer further includes at least one dummy wire that is not electrically connected to the plurality of unit cells and is not used for controlling the plurality of unit cells in order to set the interval between the adjacent control wires to be equal to or less than the predetermined interval.

19. The communication device of claim 1, wherein the at least one processor is further configured to:

control a refractive index of at least one unit cell among the plurality of unit cells by an external control signal based on a position of the at least one unit cell.

20. The communication device of claim 1, wherein the overlapped portions of the first conductive member and the second conductive member are arranged such that an external electromagnetic wave is incident perpendicularly on the conductive members in the overlapped portion or an electric field component of an external electromagnetic wave perpendicularly incident on the unit cell and an electric field component formed according to voltage application in a variable capacitor region of the unit cell becomes perpendicular to each other.

* * * * *